US008237629B2

(12) United States Patent
Homma et al.

(10) Patent No.: US 8,237,629 B2
(45) Date of Patent: Aug. 7, 2012

(54) METHOD, CIRCUIT AND PROGRAM FOR DRIVING PLASMA DISPLAY PANEL

(75) Inventors: Hajime Homma, Kagoshima Prefecture (JP); Mitsuhiro Ishizuka, Kagoshima Prefecture (JP); Shinji Hirakawa, Kagoshima Prefecture (JP); Shinya Tsuchida, Kagoshima Prefecture (JP); Koji Hashimoto, Kagoshima Prefecture (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 907 days.

(21) Appl. No.: 12/314,581

(22) Filed: Dec. 12, 2008

(65) Prior Publication Data

US 2009/0102756 A1 Apr. 23, 2009

Related U.S. Application Data

(62) Division of application No. 11/104,648, filed on Apr. 13, 2005, now Pat. No. 7,482,999.

(30) Foreign Application Priority Data

Apr. 14, 2004 (JP) ..... 2004-119244

(51) Int. Cl.
*G09G 3/28* (2006.01)

(52) U.S. Cl. ..... 345/60; 345/61

(58) Field of Classification Search ..... 345/60–68; 315/169.1–169.4

See application file for complete search history.

(56) References Cited

U.S. PATENT DOCUMENTS 6,621,229 B2 * 9/2003 Kanazawa et al. ..... 315/169.3
6,836,261 B1 * 12/2004 Kishi et al. ..... 345/60
7,218,292 B2 * 5/2007 Kashio et al. ..... 345/60
2001/0020923 A1 * 9/2001 Homma ..... 345/60
2002/0021264 A1 2/2002 Nakamura
2002/0093291 A1 * 7/2002 Kanazawa et al. ..... 315/169.4
2003/0102814 A1 * 6/2003 Kashio ..... 315/169.4
2007/0075934 A1 * 4/2007 Hirose et al. ..... 345/67

FOREIGN PATENT DOCUMENTS

JP 2001-255847 9/2001

* cited by examiner

*Primary Examiner* — Nitin Patel

(74) *Attorney, Agent, or Firm* — Drinker Biddle & Reath LLP

(57) ABSTRACT

Disclosed is a method of driving a plasma display panel. In this method, one field corresponding to one image is divided into a plurality of sub-fields, and at least one second sub-field is arranged after a first sub-field. In the first sub-field, the method comprises a first step of forming wall charges with negative polarity near the scanning electrode and forming wall charges with positive polarity near the common electrode and the data electrode; a second step of adjusting an amount of the wall charges with negative polarity near the scanning electrode and an amount of the wall charges with positive polarity near the common electrode and the data electrode; a third step of generating a writing discharge in a selected display cell of the display cells; a fourth step of generating light emission for display; and a fifth step of erasing a part of the wall charges in the display cell which emits light in the fourth step. In the second sub-field, the method comprises the same steps as the third, fourth and fifth steps. A potential difference between a scanning electrode and a common electrode in each of the fifth steps in the first and second sub-fields is set to be smaller than a potential difference between a scanning electrode and a common electrode in each of the third steps in the first and second sub-fields.

4 Claims, 38 Drawing Sheets

PRIOR ART (NO Pr SKIPPED SF)

PRIOR ART (Pr SKIPPED SF INCLUDED; COMMON ELECTRODE POTENTIAL AT SUSTAINING ERASE PERIOD = Vsw1)

PRIOR ART (Pr SKIPPED SF INCLUDED; COMMON ELECTRODE POTENTIAL AT SUSTAINING ERASE PERIOD = Vs)

METHOD, CIRCUIT AND PROGRAM FOR DRIVING PLASMA DISPLAY PANEL

This is a divisional application of application Ser. No. 11/104,648, filed on Apr. 13, 2005, now U.S. Pat. No. 7,482,999, which is incorporated by reference herein in its entirety.

BACKGROUND OF THE INVENTION

1. Field of the Invention

The present invention relates to a method, circuit and program for driving plasma display panels.

2. Description of the Related Art

Plasma display panels have many features of: (1) a thin structure and a less flickering, (2) a high contrast ratio, (3) relatively large-area screen, (4) a fast response speed, and (5) a self-emissive type and a capability of multi-color emission by using fluorescent material. Therefore plasma display panels are widely used in the computer related fields of display devices and color image displays.

At the moment there are strong demands for plasma display panels to increase brightness (a higher brightness) and to increase display contrast (a higher contrast).

Plasma display panels are classified into two types depending on the operation modes: an AC type where electrodes are coated with dielectrics and operated indirectly in an AC discharge manner; and a DC type where electrodes are exposed in the discharge space and operated in a DC discharge manner. The AC type plasma display panels are classified into: a memory operation type where the memory operation in the display cells is used as the driving mode; and a refresh operation type where the memory operation is not used. The brightness of the plasma display panel is in proportion to the frequency of discharges, that is the number of repetitions of application of pulse voltage. The refresh type AC plasma display panel, of which brightness drops as the display capacity increases, is primarily used for a small display capacity plasma display panel.

FIG. 25 is a perspective view depicting a general configuration of the AC type plasma display panel.

The AC type plasma display panel is comprised of a front substrate which faces the user (viewer) side, and a back substrate which positions at the far side of the user.

The front substrate further comprises an insulating substrate 101 which is made of glass, first transparent electrodes 103*a* which are disposed with spacing on the insulating substrate 101 in the horizontal direction of the panel, second transparent electrodes 104*a* which are disposed on the insulating substrate 101 so as to face the first transparent electrodes 103*a*, trace electrodes (bus electrodes) 105 which are disposed overlaying the first transparent electrodes 103*a* extending in the horizontal direction (lateral direction) of the panel, trace electrodes (bus electrodes) 106 which are disposed overlaying the second transparent electrodes 104*a* extending parallel to the trace electrodes (bus electrodes) 105, a dielectric film 110 which is formed on the insulating substrate 101 so as to cover the first transparent electrodes 103*a*, the second transparent electrodes 104*a* and both of the trace electrodes 105 and 106, and a protective layer 112 made from magnesium oxide which is formed on the dielectric film 110 to protect the dielectric film 110 from discharge.

The trace electrodes 105 and 106 are electrodes with about a 1-10 μm thickness, comprised of CrCu thin film and Cr thin film, and are disposed for decreasing the electric resistance value between the first transparent electrodes 103*a* and the second transparent electrodes 104*a* and an external drive device.

The electrodes comprised of the first transparent electrodes 103*a* and the trace electrodes 105 are called scanning electrodes 103, and the electrodes comprised of the second transparent electrodes 104*a* and the trace electrodes 106 are called common electrodes (sustaining electrodes) 104.

The back substrate is comprised of an insulating substrate 102 made of glass, a plurality of data electrodes 107 which extend in a direction perpendicular to the scanning electrodes 103 and the common electrodes 104 on the insulating substrate 102, a dielectric film 113 which is formed to cover the data electrodes 107 on the insulating substrate 102, a plurality of barriers 109 which are formed on the dielectric film 113 with spacing for partitioning the display cells, and a fluorescent material 111 formed on the exposed face of the dielectric film 113 and on the side wall of each barrier 109.

A discharge gas space 108 separated by barriers 109 is formed between the front substrate and the back substrate. In this discharge gas space 108, discharge gas containing helium, neon, xenon or a mixed gas thereof is filled. The fluorescent material 111 converts ultraviolet generated by the discharge of this discharge gas into visible light. This visible light reaches the user via the transparent insulating substrate 101.

Now the writing select type drive operation of a conventional plasma display panel constructed as in the above description will be described.

The plasma display panel operates according to the sub-field method. The sub-field method is a method of dividing one field constituting a screen into a plurality of sub-fields (SF) and driving the plasma display panel for each sub-field.

FIG. 26 is a diagram depicting the relationship between one field and sub-fields.

As FIG. 26 shows, 1 field is divided into 8 sub-fields (SF1-SF8), and each sub-field is comprised of 5 periods: a priming (hereafter "priming" may be abbreviated to "Pr") period; a priming (Pr) erase period, a writing period, a sustaining period and sustaining erase period.

Hereafter it is assumed that the reference potential of the scanning electrodes 103 and the common electrodes 104 is the sustaining voltage Vs, and a potential higher than the sustaining voltage Vs is positive polarity and a potential lower than the sustaining voltage Vs is negative polarity. It is also assumed that the reference potential of the data electrode 107 is the ground potential GND, and a potential higher than the ground potential GND is positive polarity, and a potential lower than the ground potential GND is negative polarity.

FIG. 27 is a timing chart depicting the writing select type drive operation of the plasma display panel shown in FIG. 25. FIG. 28 to FIG. 37 are diagrams depicting the wall charges forming status after each of the abovementioned 5 periods complete.

In the priming period at the beginning of each sub-field, saw tooth wave Pr pulses Ppr-s are applied to the scanning electrodes 103, and rectangular wave Pr pulses Ppr-c are applied to the common electrodes 104. The potential difference between the saw tooth wave Pr pulse Ppr-s and the rectangular wave Pr pulse Ppr-c is set such that the potential difference is larger than that of the discharge start voltages or more of the surface discharge and the counter discharge. Therefore the surface discharge between the scanning electrodes 103 and the common electrodes 104, and the counter discharge between the scanning electrodes 103 and the data electrodes 107 are generated.

The Pr pulses Ppr-s to be applied to the scanning electrodes 103 are saw tooth waves, so the generation and the stop of discharge are repeated according to the rise of the Pr pulses Ppr-s, as stated in Technical Report of IEICE (THE INSTI- TUTE OF ELECTRONICS, INFORMATION AND COMMUNICATION ENGINEERS) EID 98-95, (1999-01), pp. 91-96. Therefore the emission intensity is weaker than the subsequent discharge, that is the writing discharge and the sustaining discharge.

However the priming discharge (also called a pre-discharge or reset discharge) is generated in all the display cells whether an image is displayed or not, so emission by this priming discharge corresponds to the background brightness, that is black brightness. As the voltage gradient of the saw tooth wave Pr pulses Ppr-s becomes smaller, the black brightness decreases, but if the voltage gradient becomes too small, the time required to reach the voltage necessary for the priming discharge becomes long, and as a result the priming period becomes long. Then it is unavoidable to decrease the sustaining period, and as a result the sustaining discharge count decreases and the brightness of the white display drops, which drops contrast. Therefore to balance these elements, a voltage gradient of about 4V/μ seconds is normally used.

By this priming discharge, active particles (priming particles) to generate the discharge of display cells more easily are generated, and at the same time, as shown in FIG. 28, wall charges with negative polarity are attached on the scanning electrodes 103 and wall charges with positive polarity are attached on the common electrodes 104.

In the priming erase period after the priming period, saw tooth wave Pr erase pulses Ppe-s with negative polarity are applied to the scanning electrodes 103. By applying these pulses, a discharge with a weak emission intensity is generated, just like the priming discharge, and as a result the surface discharge between the scanning electrodes 103 and the common electrodes 104, and the counter discharge between the scanning electrodes 103 and the data electrodes 107 are generated. Because of this, the negative polarity wall charges near the scanning electrodes 103, the positive polarity wall charges near the common electrodes 104, and the positive polarity wall charges near the data electrodes 107, generated in the Pr period, decrease as shown in FIG. 29.

The increase and decrease of the wall charges are relatively shown by the number of wall charges shown in each figure. For example, in FIG. 28 the number of negative polarity wall charges near the scanning electrode 103 is 24, the number of positive polarity wall charges near the common electrode 104 is 15, and the number of positive polarity wall charges near the data electrode 107 is 9, but in FIG. 29, these have been decreased to 18, 12 and 6 respectively.

By generating wall charges in this way, the writing discharge can be generated more easily in the subsequent writing period. If wall charges are not adjusted in the priming erase period, a surface discharge is generated between the scanning electrodes 103 and the common electrodes 104 even if data pulses Pd are not applied in the writing period, since very many wall charges have been generated in the priming period, so the possibility of an erred display increases.

The writing period after the priming erase period is a period for selecting the display cells to be emitted, and during this writing period, the potential of the scanning electrode 103 is held at the scanning base potential Vbw, the positive polarity rectangular wave pulses Pw-c are applied to the common electrodes 104, and the potential of the common electrodes 104 is held at the first bias voltage Vsw1, except during the period when the scanning pulses Pw-s are applied. The negative polarity scanning pulses Pw-s with potential Vw are linearly and sequentially applied to the scanning electrodes 103 for each line to be scanned.

On the other hand, positive polarity data pulses Pw-d are applied to the data electrodes 107 synchronizing with the scanning pulses Pw-s according to the display cells to be selected.

When the scanning pulses Pw-s and the data pulses Pw-d synchronize, a writing discharge is generated only in the display cells at the intersection of the scanning electrode 103 and the data electrode 107 to which these pulses are applied, and the wall charges shown in FIG. 30 are attached.

Whereas a writing discharge is not generated in display cells to which the data pulses Pw-d are not applied, so wall charges after priming erase discharge (see FIG. 29) are held in these display cells.

The sustaining period is a period of time for light emission for display, and negative polarity sustaining pulses Psus-s and Psus-c, which start with the common electrodes 104 side and are alternately applied to the scanning electrodes 103 side and the common electrodes 104 side, are applied to the scanning electrodes 103 and the common electrodes 104. In this sustaining period, the sustaining pulse which is applied first is called the first sustaining pulse, the next sustaining pulse is called the second sustaining pulse, and the sustaining pulse which is applied last is called the final sustaining pulse.

In the display cells in which a writing discharge was generated during the writing period, positive charges are attached to the scanning electrode 103, and negative charges are attached to the common electrode 104, and the negative polarity sustaining pulse voltage Vs to the common electrode 104 and a wall charge voltage are superimposed, voltage after superimposing exceeds the surface discharge start voltage, and a surface discharge is generated.

If a surface discharge is generated, wall charges are located so as to cancel voltage which is being applied to the scanning electrode 103 and the common electrode 104 respectively as shown in FIG. 31. In other words, negative charges are attached to the common electrode 104, and positive charges are attached to the scanning electrode 103. Since the next sustaining pulse is a positive voltage pulse at the scanning electrode side, an effective voltage to be applied to the discharge gas space 108 exceeds the discharge start voltage by superimposing with the wall charges, a discharge is generated, and wall charges are generated as shown in FIG. 32. In the wall charges generated by the surface discharge between the scanning electrodes 103 and the common electrodes 104, polarity is switched between the scanning electrodes 103 and the common electrodes 104 each time the sustaining pulse is applied.

The amount of the wall charges in the display cells in which writing was not performed during the writing period, on the other hand, is so small that a sustaining discharge is not generated even if sustaining pulses are applied. Therefore the wall charges after the priming erase period completes, shown in FIG. 29, are maintained as is.

When the surface discharge start voltage and the counter discharge start voltage of a plasma display panel are compared, the counter discharge start voltage is generally higher than the surface discharge start voltage. Because of this, when the first sustaining pulses are applied, the surface discharge is generated but the counter discharge is not. Therefore after the first sustaining pulses are applied, the status of the wall charges near the data electrode 107 is the same as the status after the writing discharge completes.

However by repeating the sustaining discharge, the wall charges for the amount of voltage exceeding the surface discharge start voltage are stored on the scanning electrode 103 and the common electrode 104, so the wall charges increase more than those in writing. Because of this, the negative polarity wall charges of the data electrode 107, the positive polarity wall charges of the scanning electrode 103 and the common electrode 104, and the sustaining pulse voltage Vs exceed the counter discharge start voltage, and a counter discharge is also generated, and as a result the positive charges are stored in the data electrode 107 as shown in FIG. 33. And if the sustaining discharge continues to be repeated, the wall charges to be formed near the scanning electrode 103 and the common electrode 104 also saturate (become a steady state), so positive polarity wall charges to be formed near the data electrode 107 remain unchanged, and the wall charges shown in FIG. 34 and FIG. 35 are formed.

In the final sustaining erase period, the saw tooth sustaining erase pulses Pse-s with negative polarity are applied to the scanning electrode 103, and the rectangular wave pulses Pse-c with positive polarity are applied to the common electrode 104. As the sustaining erase pulses Pse-s decrease, a weak surface discharge is generated between the scanning electrode 103 and the common electrode 104, and a weak counter discharge is generated between the scanning electrode 103 and the data electrode 107 respectively. By this, a part of the wall charges of the display cell, which emitted during the sustaining period before the sustaining erase period, are erased as shown in FIG. 36 and FIG. 37.

In order to drop the black brightness in the abovementioned driving method for the plasma display panel, a method for creating sub-fields in which the priming period and the priming erase period are not set and a method for dropping the emission intensity of the priming discharge, that is a method for decreasing the potential difference between the saw tooth wave Pr pulses Ppr-s and the rectangular wave Pr pulses Ppr-c, are possible.

FIG. 38 shows an example of the timing chart based on the former method.

As FIG. 38 shows, according to this method, the sub-field SF(N+1), in which the priming period and the priming erase period are not set, is created after the sub-field SF(N), in which the priming period and the priming erase period are set.

Here after the sub-field in which the priming period and the priming erase period are not set may be called "Pr skipped SF", and the sub-field in which the priming period and the priming erase period are set may be called "Pr included SF".

An example of this method for setting Pr skipped SF and driving the plasma display panel is a method stated in Japanese Patent Application Laid-Open No. 2001-255847. According to the method stated in this document, a sub-field in which not only the priming period and the priming erase period but also the sustaining erase period is not set are created.

However the locations of the wall charges just before the writing period of Pr skipped SF are locations of wall charges after the sustaining erase discharge completes (FIG. 36) if the previous sub-field is emitted, and are locations of wall charges after the Pr erase discharge completes (FIG. 29) if the previous sub-field is not emitted, and especially when display is executed in the previous sub-field, the amount of positive charge stored near the data electrode 107 is low. Since the writing discharge is executed in this status, the minimum emission voltage Vd_min (minimum voltage among voltages with which all the display cells are emitted when the data voltage Vd is increased, normally a voltage higher than this minimum emission voltage Vd-min is set) of the display cell which emitted in the previous sub-field becomes higher than the minimum emission voltage Vd_min in the non-display cell. Or the minimum voltage Vsw1_min of the first bias voltage Vsw1 of the common electrode 104 increases since the writing discharge when the display cell is emitted in the previous sub-field becomes weak.

In other words, the minimum voltage values of the set values of the data voltage Vd and the first bias voltage Vsw1 of the common electrode 104 increase, so the drive margin drops.

The wall charges formed near the data electrode 107 depend on the number of sustaining pulses in the sub-field, and especially when the number of sustaining pulses is low, the negative polarity wall charges formed in writing are more likely to remain.

In the case of the method for dropping the emission intensity of the priming discharge, on the other hand, the wall charges to be stored near the scanning electrode 103, the common electrode 104 and the data electrode 107 decrease to be less than the wall charges shown in FIG. 28, as the potential difference between the saw tooth wave Pr pulse Ppr-s and the rectangular wave Pr pulse Ppr-c decreases, so the minimum emission voltage Vd_min and the minimum voltage Vsw1_min of the first bias voltage Vsw1 of the common electrode 104 increases, as mentioned above.

Also in the sustaining erase period in the sub-field SF(N) in FIG. 38, the potential difference between the scanning electrode 103 and the common electrode 104 decreases if the potential of the common electrode 104 is set to the sustaining voltage Vs, so the wall charges that remain near the scanning electrode 103 and the common electrode 104 are more than the wall charges in the case when the common electrode 104 is set to the first bias voltage Vsw1, and a discharge error easily occurs due to the potential difference between the scanning electrode 103 and the common electrode 104 in the writing period. If the sustaining voltage Vs is increased in this status, the voltage Vs_max with which a discharge error occurs decreases to be lower than the potential Vsw1 of the common electrode 104, and the drive margin drops in this drive waveform as well.

If the drive margin drops, it becomes difficult to absorb the characteristics difference due to the process dispersion of the plasma display panel. Therefore the wider the drive margin the better, but the decrease of the black brightness and the increase of the drive margin are in a trade-off relationship, as described above, so in a conventional plasma display, it is difficult to implement both a decrease of the black brightness and an increase of the drive margin.

SUMMARY OF THE INVENTION

In view of the foregoing problems in the conventional driving method of plasma display panels, it is an object of the present invention to provide a method, circuit and program for driving plasma display panels in which both a decrease of the black brightness and an increase of the drive margin can be achieved.

Means for solving the above problems will now be described using reference symbols to be used in the "preferred embodiments" of the invention. These reference symbols are provided only to clarify the correspondence between the description of the "Claims" and the description of the "preferred embodiments", and shall not be used for interpreting the technical scope of the disclosed invention in the Claims.

In order to achieve the object described above, according to one aspect of the present invention, there is provided a method of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the method comprising the steps of: dividing one field corresponding to one image into a plurality of sub-fields; and arranging at least one second sub-field (SF2) after a first sub-field (SF1) of the plurality of sub-fields, wherein in the first sub-field (SF1), the method comprising: a first step of forming wall charges with negative polarity near the scanning electrode (103) and forming wall charges with positive polarity near the common electrode and the data electrode (107); a second step of adjusting an amount of the wall charges with negative polarity near the scanning electrode (103) and an amount of the wall charges with positive polarity near the common electrode and the data electrode (107); a third step of generating a writing discharge in a selected display cell of the display cells; a fourth step of generating light emission for display; and a fifth step of erasing a part of the wall charges in the display cell which emits light in the fourth step; and in the second sub-field (SF2), the method comprising the same steps as the third, fourth and fifth steps, wherein each of the fifth steps in the first and second sub-fields includes setting a potential difference between the scanning electrode (103) and the common electrode to be smaller than a potential difference between the scanning electrode (103) and the common electrode in each of the third steps in the first and second sub-fields.

According to another aspect of the present invention, there is provided a method of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the method comprising the steps of: dividing one field corresponding to one image into a plurality of sub-fields; and arranging at least one second sub-field (SF2) after a first sub-field (SF1) of the plurality of sub-fields, wherein in the first sub-field (SF1), the method comprising: a first step of forming wall charges with negative polarity near the scanning electrode (103) and forming wall charges with positive polarity near the common electrode and the data electrode (107); a second step of adjusting an amount of the wall charges with negative polarity near the scanning electrode (103) and an amount of the wall charges with positive polarity near the common electrode and the data electrode (107); a third step of generating a writing discharge in a selected display cell of the display cells; a fourth step of generating light emission for display; and a fifth step of erasing a part of the wall charges in the display cell which emits light in the fourth step; and in the second sub-field (SF2), the method comprising the same steps as the third, fourth and fifth steps, wherein when a potential of the common electrode in each of the fifth steps in the first and second sub-fields is set to a potential denoted by Vsw1 of the common electrode in the third step or less, and let Ve1 denote an ultimate potential of a saw tooth pulse to be applied to the scanning electrode (103) in the fifth step, each of the fifth steps in the first and second sub-fields includes setting a potential denoted by Vsw2 of the common electrode to be higher than the potential Vsw1, and each of the fifth steps includes setting an ultimate potential of a pulse to be applied to the scanning electrode (103) to an ultimate potential denoted by Ve2 which is higher than the ultimate potential Ve1.

It is preferable that a relationship among the potential Vsw1, the potential Vsw2, the ultimate potential Ve1 and the ultimate potential Ve2 is expressed by the following equation:

$$Vsw2-Vsw1=Ve2-Ve1.$$

According to yet another aspect of the present invention, there is provided a method of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the method comprising the steps of: dividing one field corresponding to one image into a plurality of sub-fields; and arranging at least one second sub-field (SF2) after a first sub-field (SF1) of the plurality of sub-fields, wherein in the first sub-field (SF1), the method comprising: a first step of forming wall charges with negative polarity near the scanning electrode (103) and forming wall charges with positive polarity near the common electrode and the data electrode (107); a second step of adjusting an amount of the wall charges with negative polarity near the scanning electrode (103) and an amount of the wall charges with positive polarity near the common electrode and the data electrode (107); a third step of generating a writing discharge in a selected display cell of the display cells; a fourth step of generating light emission for display; and a fifth step of erasing a part of the wall charges in the display cell which emits light in the fourth step; and in the second sub-field (SF2), the method comprising the same steps as the third, fourth and fifth steps, wherein each of the fourth steps in the first and second sub-fields includes adding an auxiliary pulse (Pa) to at least one sustaining pulse of a plurality of sustaining pulses to be applied to the scanning electrode (103), the auxiliary pulse (Pa) having a potential higher than a potential denoted by Vs of the at least one sustaining pulse.

The auxiliary pulse (Pa) is added to a final sustaining pulse of the plurality of sustaining pulses, for example.

The auxiliary pulse (Pa) is generated by decreasing a time until the final sustaining pulse is clamped to the potential Vs when the final sustaining pulse rises to the potential Vs, and overshooting the final sustaining pulse, for example.

A plurality of auxiliary pulses (Pa) are added to the at least one sustaining pulse.

According to still another aspect of the present invention, there is provided a method of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the method comprising the steps of: dividing one field corresponding to one image into a plurality of sub-fields; and arranging at least one second sub-field (SF2) after a first sub-field (SF1) of the plurality of sub-fields, wherein in the first sub-field (SF1), the method comprising: a first step of forming wall charges with negative polarity near the scanning electrode (103) and forming wall charges with positive polarity near the common electrode and the data electrode (107); a second step of adjusting an amount of the wall charges with negative polarity near the scanning electrode (103) and an amount of the wall charges with positive polarity near the common electrode and the data electrode (107); a third step of generating a writing discharge in a selected display cell of the display cells; a fourth step of generating light emission for display; and a fifth step of erasing a part of the wall charges in the display cell which emits light in the fourth step; and in the second sub-field (SF2), the method comprising the same steps as the third, fourth and fifth steps, wherein each of the fifth steps in the first and second sub-fields includes setting a potential difference between the scanning electrode (103) and the common electrode to be smaller than a potential difference between the scanning electrode (103) and the common electrode in each of the third steps in the first and second sub-fields, and the second step in the first sub-field (SF1) includes setting a potential of the common electrode to be equal to a potential of the common electrode in the fifth step.

It is preferable that the potential of the common electrode in each of the fifth steps in the first and second sub-fields is set to be lower than the potential of the common electrode in each of the third steps in the first and second sub-fields.

It is preferable that let Ve1 denote an ultimate potential of saw tooth pulses to be applied to the scanning electrode (103) in each of the fifth steps in the first and second sub-fields, and a time during which the ultimate potential of the saw tooth pulses is held at the potential Ve1 is 5 μs or less.

It is preferable that a potential to be applied to the common electrode drops according to a linear function from a first potential to a second potential during a part of a period of the fifth step in the first sub-field (SF1).

According to still another aspect of the present invention, there is provided a drive circuit for driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the drive circuit comprising: a control device (22) for dividing one field corresponding to one image into a plurality of sub-fields and arranging at least one second sub-field (SF2) after a first sub-field (SF1) of the plurality of sub-fields, wherein in the first sub-field (SF1), the control device (22) supplies a first control signal for performing a first operation of forming wall charges with negative polarity near the scanning electrode (103) and forming wall charges with positive polarity near the common electrode and the data electrode (107); a second control signal for performing a second operation of adjusting an amount of the wall charges with negative polarity near the scanning electrode (103) and an amount of the wall charges with positive polarity near the common electrode and the data electrode (107); a third control signal for performing a third operation of generating a writing discharge in a selected display cell of the display cells; a fourth control signal for performing a fourth operation of generating light emission for display; and a fifth control signal for performing a fifth operation of erasing a part of the wall charges in the display cell which emits light in the fourth operation; and in the second sub-field (SF2), the control device (22) supplies the same signals as the third, fourth and fifth control signals, wherein the control device (22) sets each of potentials of the scanning electrode (103) and the common electrode such that a potential difference between the scanning electrode (103) and the common electrode in each of the fifth operations in the first and second sub-fields is set to be smaller than a potential difference between the scanning electrode (103) and the common electrode in each of the third operations in the first and second sub-fields.

According to still another aspect of the present invention, there is provided a drive circuit for driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the drive circuit comprising: a control device (22) for dividing one field corresponding to one image into a plurality of sub-fields and arranging at least one second sub-field (SF2) after a first sub-field (SF1) of the plurality of sub-fields, wherein in the first sub-field (SF1), the control device (22) supplies a first control signal for performing a first operation of forming wall charges with negative polarity near the scanning electrode (103) and forming wall charges with positive polarity near the common electrode and the data electrode (107); a second control signal for performing a second operation of adjusting an amount of the wall charges with negative polarity near the scanning electrode (103) and an amount of the wall charges with positive polarity near the common electrode and the data electrode (107); a third control signal for performing a third operation of generating a writing discharge in a selected display cell of the display cells; a fourth control signal for performing a fourth operation of generating light emission for display; and a fifth control signal for performing a fifth operation of erasing a part of the wall charges in the display cell which emits light in the fourth operation; and in the second sub-field (SF2), the control device (22) supplies the same signals as the third, fourth and fifth control signals, wherein when a potential of the common electrode in each of the fifth operations in the first and second sub-fields is set to a potential denoted by Vsw1 of the common electrode in the third operation or less, and let Ve1 denote an ultimate potential of a saw tooth pulse to be applied to the scanning electrode (103) in the fifth operation, the control device (22) sets a potential denoted by Vsw2 of the common electrode to be higher than the potential Vsw1 in each of the fifth operations in the first and second sub-fields, and sets an ultimate potential of a pulse to be applied to the scanning electrode (103) to an ultimate potential denoted by Ve2 which is higher than the ultimate potential Ve1 in each of the fifth operations.

The control device (22) can set the potential Vsw1, the potential Vsw2, the ultimate potential Ve1 and the ultimate potential Ve2 such that a relationship among the potentials Vsw1, Vsw2, Ve1 and Ve2 is expressed by the following equation:

$$Vsw2-Vsw1=Ve2-Ve1.$$

According to still another aspect of the present invention, there is provided a drive circuit for driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the drive circuit comprising: a control device (22) for dividing one field corresponding to one image into a plurality of sub-fields and arranging at least one second sub-field (SF2) after a first sub-field (SF1) of the plurality of sub-fields, wherein in the first sub-field (SF1), the control device (22) supplies a first control signal for performing a first operation of forming wall charges with negative polarity near the scanning electrode (103) and forming wall charges with positive polarity near the common electrode and the data electrode (107); a second control signal for performing a second operation of adjusting an amount of the wall charges with negative polarity near the scanning electrode (103) and an amount of the wall charges with positive polarity near the common electrode and the data electrode (107); a third control signal for performing a third operation of generating a writing discharge in a selected display cell of the display cells; a fourth control signal for performing a fourth operation of generating light emission for display; and a fifth control signal for performing a fifth operation of erasing a part of the wall charges in the display cell which emits light in the fourth operation; and in the second sub-field (SF2), the control device (22) supplies the same signals as the third, fourth and fifth control signals, wherein in each of the fourth operations in the first and second sub-fields, the control device (22) adds an auxiliary pulse (Pa) to at least one sustaining pulse of a plurality of sustaining pulses to be applied to the scanning electrode (103), the auxiliary pulse (Pa) having a potential higher than a potential denoted by Vs of the at least one sustaining pulse.

The control device (22) can add the auxiliary pulse (Pa) to a final sustaining pulse of the plurality of sustaining pulses.

The control device (22) generates the auxiliary pulse (Pa) by decreasing a time until the final sustaining pulse is clamped to the potential Vs when the final sustaining pulse rises to the potential Vs, and overshooting the final sustaining pulse, for example.

The control device (22) can add a plurality of auxiliary pulses (Pa) to the sustaining pulse.

According to still another aspect of the present invention, there is provided a drive circuit for driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the drive circuit comprising: a control device (22) for dividing one field corresponding to one image into a plurality of sub-fields and arranging at least one second sub-field (SF2) after a first sub-field (SF1) of the plurality of sub-fields, wherein in the first sub-field (SF1), the control device (22) supplies a first control signal for performing a first operation of forming wall charges with negative polarity near the scanning electrode (103) and forming wall charges with positive polarity near the common electrode and the data electrode (107); a second control signal for performing a second operation of adjusting an amount of the wall charges with negative polarity near the scanning electrode (103) and an amount of the wall charges with positive polarity near the common electrode and the data electrode (107); a third control signal for performing a third operation of generating a writing discharge in a selected display cell of the display cells; a fourth control signal for performing a fourth operation of generating light emission for display; and a fifth control signal for performing a fifth operation of erasing a part of the wall charges in the display cell which emits light in the fourth operation; and in the second sub-field (SF2), the control device (22) supplies the same signals as the third, fourth and fifth control signals, wherein the control device (22) sets a potential difference between the scanning electrode (103) and the common electrode in each of the fifth operations in the first and second sub-fields to be smaller than a potential difference between the scanning electrode (103) and the common electrode in each of the third operations in the first and second sub-fields, and sets a potential of the common electrode in the second operation in the first sub-field (SF1) to be equal to a potential of the common electrode in the fifth operation.

The control device (22) can set a potential of the common electrode in each of the fifth operations in the first and second sub-fields to be lower than a potential of the common electrode in each of the third operations in the first and second sub-fields, for example.

Let Ve1 denote an ultimate potential of saw tooth pulses to be applied to the scanning electrode (103) in each of the fifth operations in the first and second sub-fields, and a time during which the ultimate potential of the saw tooth pulses is held at the potential Ve1 is 5 μs or less.

It is preferable that a potential to be applied to the common electrode drops according to a linear function from a first potential to a second potential during a part of a period of the fifth operation in the first sub-field (SF1).

According to still another aspect of the present invention, there is provided a plasma display device a plasma display panel, and the abovementioned drive circuit for driving the plasma display panel.

According to still another aspect of the present invention, there is provided a program for causing a computer to perform a process of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the process comprising the steps of: dividing one field corresponding to one image into a plurality of sub-fields; and arranging at least one second sub-field (SF2) after a first sub-field (SF1) of the plurality of sub-fields, wherein in the first sub-field (SF1), the process comprises a first set of the steps of: supplying a first control signal for performing a first operation of forming wall charges with negative polarity near the scanning electrode (103) and forming wall charges with positive polarity near the common electrode and the data electrode (107); supplying a second control signal for performing a second operation of adjusting an amount of the wall charges with negative polarity near the scanning electrode (103) and an amount of the wall charges with positive polarity near the common electrode and the data electrode (107); supplying a third control signal for performing a third operation of generating a writing discharge in a selected display cell of the display cells; supplying a fourth control signal for performing a fourth operation of generating light emission for display; and supplying a fifth control signal for performing a fifth operation of erasing a part of the wall charges in the display cell which emits light in the fourth operation; in the second sub-field (SF2), the process comprises a second set of the steps of supplying the same signals as the third, fourth and fifth control signals; and the process comprises a third set of the steps of setting each of potentials of the scanning electrode (103) and the common electrode such that a potential difference between the scanning electrode (103) and the common electrode in each of the fifth operations in the first and second sub-fields is set to be smaller than a potential difference between the scanning electrode (103) and the common electrode in each of the third operations in the first and second sub-fields.

According to still another aspect of the present invention, there is provided a program for causing a computer to perform a process of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the process comprising the steps of: dividing one field corresponding to one image into a plurality of sub-fields; and arranging at least one second sub-field (SF2) after a first sub-field (SF1) of the plurality of sub-fields, wherein in the first sub-field (SF1), the process comprises a first set of the steps of: supplying a first control signal for performing a first operation of forming wall charges with negative polarity near the scanning electrode (103) and forming wall charges with positive polarity near the common electrode and the data electrode (107); supplying a second control signal for performing a second operation of adjusting an amount of the wall charges with negative polarity near the scanning electrode (103) and an amount of the wall charges with positive polarity near the common electrode and the data electrode (107); supplying a third control signal for performing a third operation of generating a writing discharge in a selected display cell of the display cells; supplying a fourth control signal for performing a fourth operation of generating light emission for display; and supplying a fifth control signal for performing a fifth operation of erasing a part of the wall charges in the display cell which emits light in the fourth operation; in the second sub-field (SF2), the process comprises a second set of the steps of supplying the same signals as the third, fourth and fifth control signals; and when a potential of the common electrode in each of the fifth operations in the first and second sub-fields is set to a potential denoted by Vsw1 of the common electrode in the third operation or less, and let Ve1 denote an ultimate potential of a saw tooth pulse to be applied to the scanning electrode (103) in the fifth operation, the process comprises a third set of the steps of setting a potential denoted by Vsw2 of the common electrode to be higher than the potential Vsw1 in each of the fifth operations in the first and second sub-fields; and setting an ultimate potential of a pulse to be applied to the scanning electrode (103) to an ultimate potential denoted by Ve2 which is higher than the ultimate potential Ve1 in each of the fifth operations.

It is preferable that the third operation includes setting the potential Vsw1, the potential Vsw2, the ultimate potential Ve1 and the ultimate potential Ve2 such that a relationship among the potentials Vsw1, Vsw2, Ve1 and Ve2 is expressed by the following equation:

$$Vsw2-Vsw1=Ve2-Ve1.$$

According to still another aspect of the present invention, there is provided a program for causing a computer to perform a process of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the process comprising the steps of: dividing one field corresponding to one image into a plurality of sub-fields; and arranging at least one second sub-field (SF2) after a first sub-field (SF1) of the plurality of sub-fields, wherein in the first sub-field (SF1), the process comprises a first set of the steps of: supplying a first control signal for performing a first operation of forming wall charges with negative polarity near the scanning electrode (103) and forming wall charges with positive polarity near the common electrode and the data electrode (107); supplying a second control signal for performing a second operation of adjusting an amount of the wall charges with negative polarity near the scanning electrode (103) and an amount of the wall charges with positive polarity near the common electrode and the data electrode (107); supplying a third control signal for performing a third operation of generating a writing discharge in a selected display cell of the display cells; supplying a fourth control signal for performing a fourth operation of generating light emission for display; and supplying a fifth control signal for performing a fifth operation of erasing a part of the wall charges in the display cell which emits light in the fourth operation; in the second sub-field (SF2), the process comprises a second set of the steps of supplying the same signals as the third, fourth and fifth control signals; and the process comprises a third set of the steps of adding an auxiliary pulse (Pa) to at least one sustaining pulse of a plurality of sustaining pulses to be applied to the scanning electrode (103) in each of the fourth operations in the first and second sub-fields, the auxiliary pulse (Pa) having a potential higher than a potential denoted by Vs of the at least one sustaining pulse.

It is preferable that the auxiliary pulse (Pa) is added to a final sustaining pulse of the plurality of sustaining pulses in the third operation.

In the third operation, the auxiliary pulse (Pa) is generated by decreasing a time until the final sustaining pulse is clamped to the potential Vs when the final sustaining pulse rises to the potential Vs, and overshooting the final sustaining pulse, for example.

In the third operation, a plurality of auxiliary pulses (Pa) can be added to the sustaining pulse in the third operation.

According to still another aspect of the present invention, there is provided a program for causing a computer to perform a process of driving a plasma display panel on which images are displayed of a video signal, the plasma display panel comprising a first substrate (101), a second substrate (102) disposed facing the first substrate (101), a plurality of scanning electrodes (103) that are disposed on a surface of the first substrate (101) facing the second substrate (102) and extend in a first direction, a plurality of common electrodes that extend parallel with the scanning electrodes (103) on the surface facing the second substrate (102) and are disposed alternately with the scanning electrodes (103), a plurality of data electrodes (107) that are disposed on a surface of the second substrate (102) facing the first substrate (101) and extend in a second direction crossing the first direction, and display cells disposed at the respective intersections of pairs of the scanning electrode (103) and the common electrode with the data electrodes (107), the process comprising the steps of: dividing one field corresponding to one image into a plurality of sub-fields; and arranging at least one second sub-field (SF2) after a first sub-field (SF1) of the plurality of sub-fields, wherein in the first sub-field (SF1), the process comprises a first set of the steps of: supplying a first control signal for performing a first operation of forming wall charges with negative polarity near the scanning electrode (103) and forming wall charges with positive polarity near the common electrode and the data electrode (107); supplying a second control signal for performing a second operation of adjusting an amount of the wall charges with negative polarity near the scanning electrode (103) and an amount of the wall charges with positive polarity near the common electrode and the data electrode (107); supplying a third control signal for performing a third operation of generating a writing discharge in a selected display cell of the display cells; supplying a fourth control signal for performing a fourth operation of generating light emission for display; and supplying a fifth control signal for performing a fifth operation of erasing a part of the wall charges in the display cell which emits light in the fourth operation; in the second sub-field (SF2), the process comprises a second set of the steps of supplying the same signals as the third, fourth and fifth control signals; and the process comprises a third set of the steps of setting a potential difference between the scanning electrode (103) and the common electrode in each of the fifth operations in the first and second sub-fields to be smaller than a potential difference between the scanning electrode (103) and the common electrode in each of the third operations in the first and second sub-fields; and setting a potential of the common electrode in the second operation in the first sub-field (SF1) to be equal to a potential of the common electrode in the fifth operation.

It is preferable that let Ve1 denote an ultimate potential of saw tooth pulses to be applied to the scanning electrode (103) in each of the fifth operations in the first and second sub-fields, and a time during which the ultimate potential of the saw tooth pulses is held at the potential Ve1 is 5 μs or less.

It is preferable that a potential to be applied to the common electrode drops according to a linear function from a first potential to a second potential during a part of a period of the fifth operation in the first sub-field (SF1).

According to the present invention, in the sustaining erase period of the sub-field just before the sub-field in which the priming period and the priming erase period are not set ("Pr skipped sub-field" in the later mentioned embodiment), the surface potential difference (potential difference between the scanning electrode (103) and the common electrode) and the counter potential difference (potential difference between the scanning electrode (103) or the common electrode and the data electrode (107)) are set to low values so as to weaken the surface discharge and the counter discharge. By this, the writing characteristics of the Pr skipped sub-field can be improved, the driving margin can be increased, and the background brightness (black brightness) can be decreased.

Further features of the invention, its negative and various advantages will be more apparent from the accompanying drawings and the following detailed description of the preferred embodiments.

DETAILED DESCRIPTION OF THE INVENTION

First Embodiment

Figure 1:
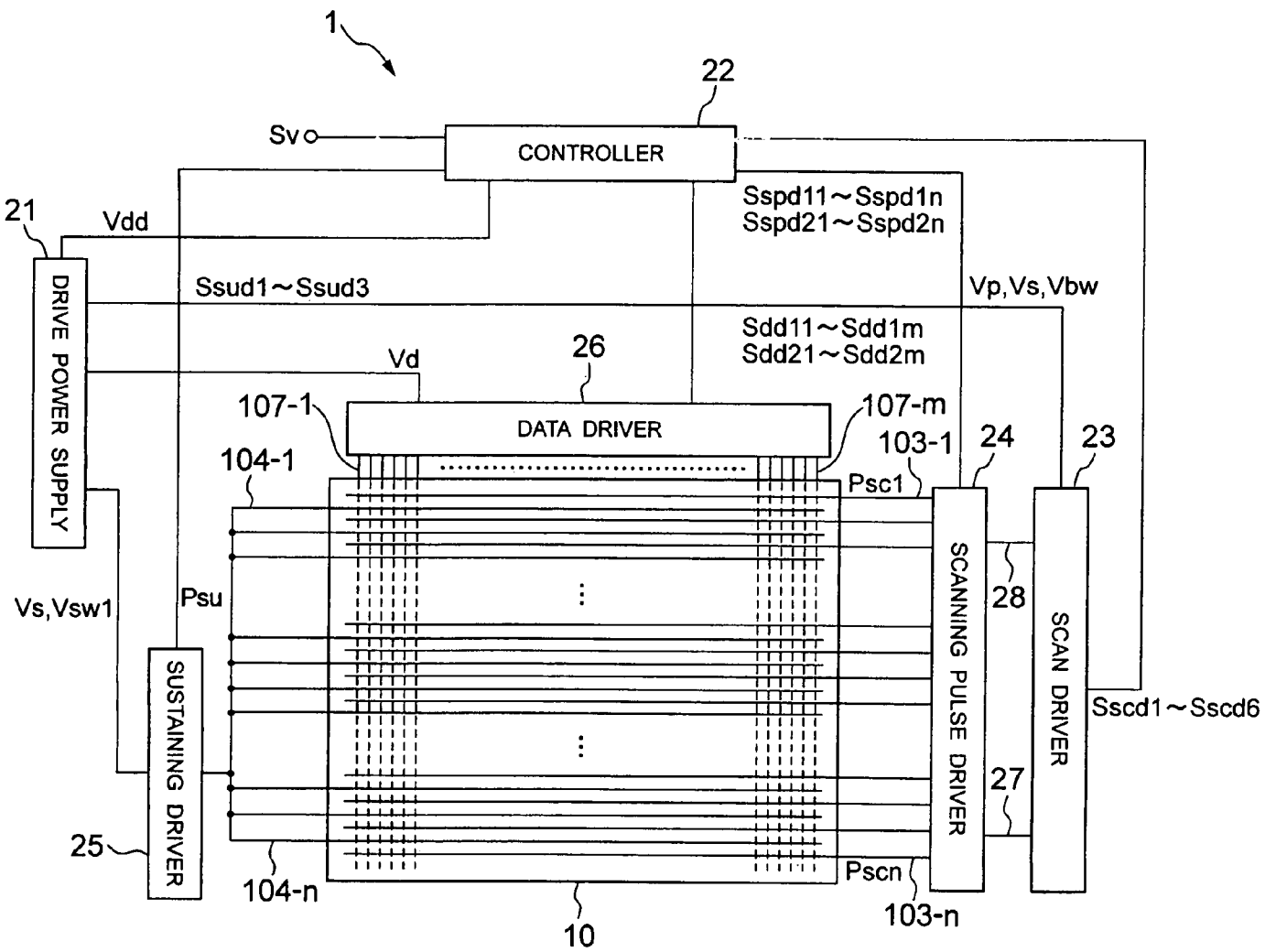
FIG. 1 is a block diagram depicting the structure of the plasma display device according to the first embodiment of the present invention.

FIG. 1 is a block diagram depicting the structure of the plasma display device according to the first embodiment of the present invention.

The plasma display device 1 according to the present invention comprises a plasma display panel 10, and a panel drive circuit (no reference symbol) for driving the plasma display panel 10.

Figure 25:
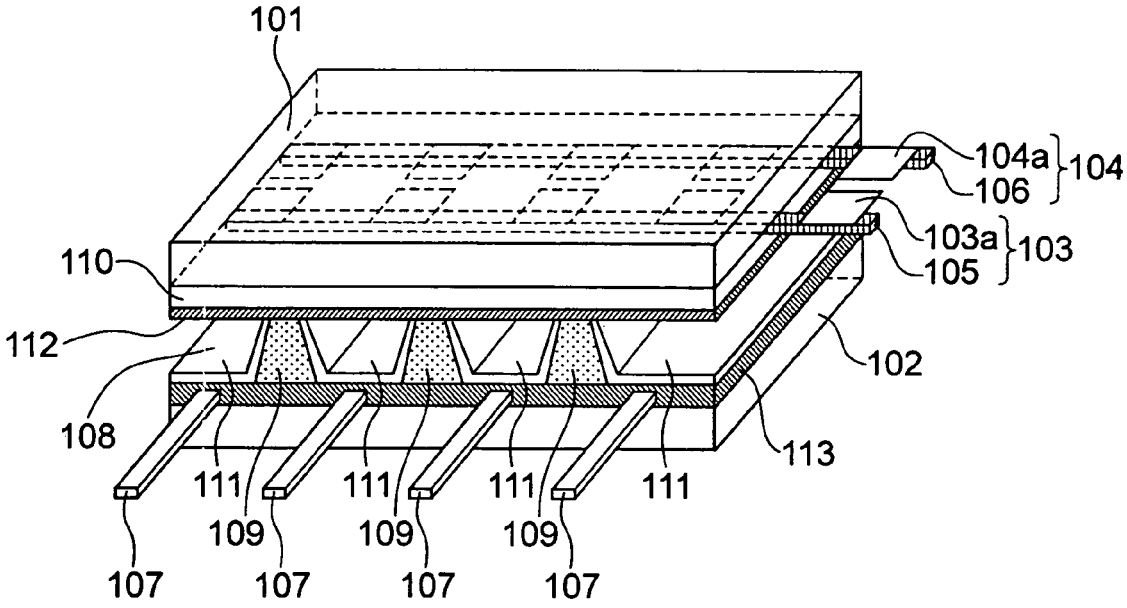
FIG. 25 is a perspective view depicting a general configuration of the AC type plasma display panel.
Figure 26:
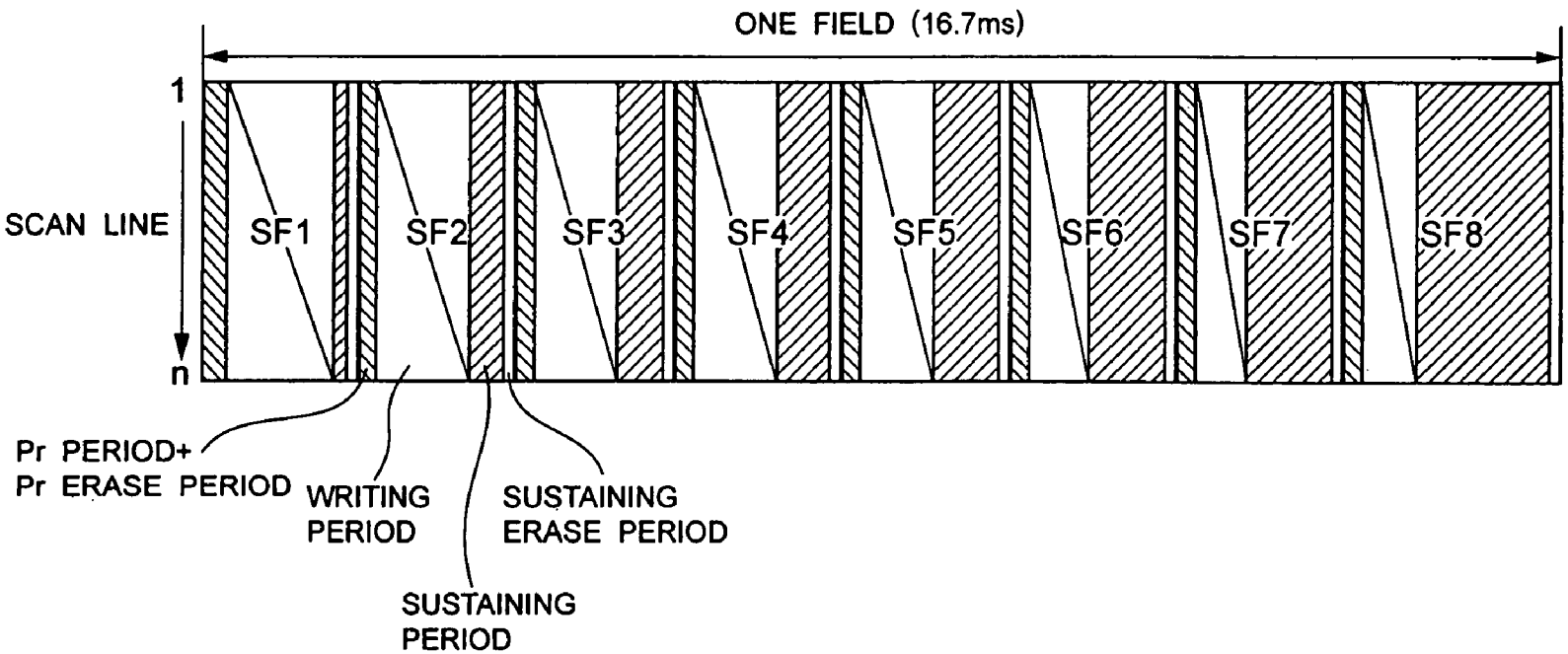
FIG. 26 is a diagram depicting the relationship between one field and a sub-field.

The plasma display panel 10 according to the present embodiment has the same structure as the conventional plasma display panel shown in FIG. 25. Therefore the composing elements the same as the composing elements of the conventional plasma display shown in FIG. 25 are denoted with the same reference symbols.

As FIG. 1 shows, the plasma display panel 10 comprises n number of (n: natural number) of scanning electrodes 103-1 to 103-n which extend in the row direction, n number of common electrodes 104-1 to 104-n which extend in the row direction, with a predetermined space from the scanning electrodes 103-1 to 103-n, alternately with the scanning electrodes 103-1 to 103-n, and m number of (m: natural number) of data electrodes 107-1 to 107-m which extend in the column direction perpendicular to the scanning electrodes 103-1 to 103-n and the common electrodes 104-1 to 104-n.

Therefore (n×m) number of display cells are created on the plasma display panel 10.

The panel drive circuit is comprised of a drive power supply 21 supplies power to each composing element constituting the plasma display device 1, a controller 22, a scan driver 23 of which operation is controlled by the controller 22, a scanning pulse driver 24 for driving the scanning electrodes 103-1 to 103-n according to the scan driver 23 and the controller 22, a sustaining driver 25 for driving the common electrodes 104-1 to 104-n according to the controller 22, and a data driver 26 for driving the data electrodes 107-1 to 107-m according to the controller 22.

Figure 2:
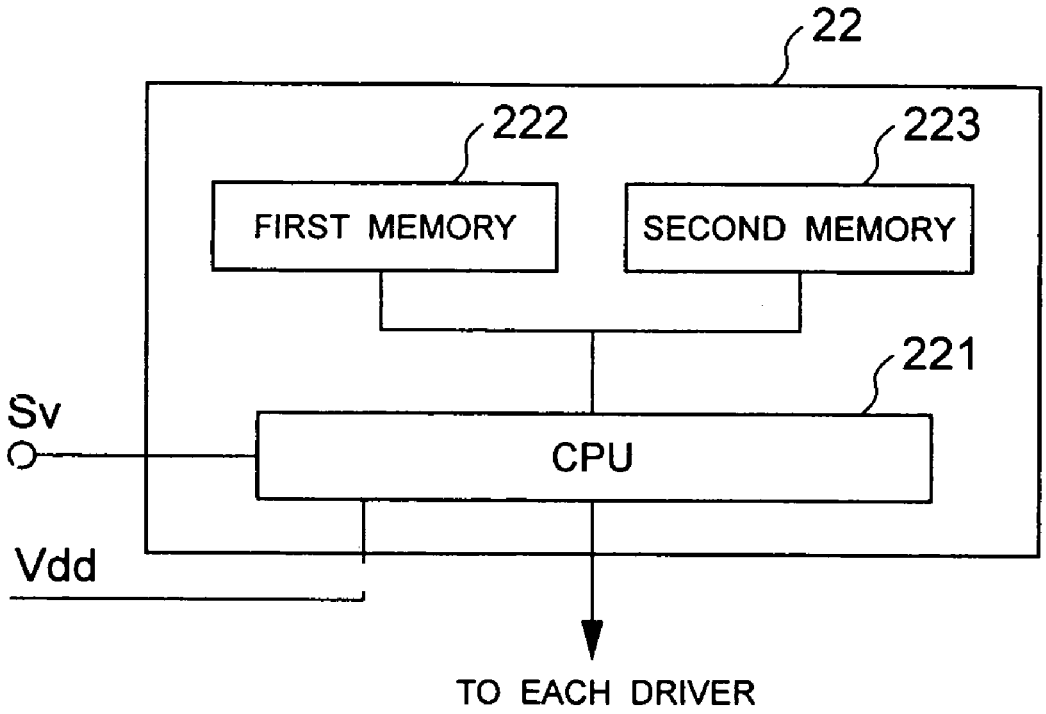
FIG. 2 is a block diagram depicting the structure of the controller in the plasma display device according to the first embodiment of the present invention.

FIG. 2 is a block diagram depicting the structure of the controller 22.

As FIG. 2 shows, the controller 22 is comprised of a central processing unit (CPU) 221, a first memory 222 and a second memory 223.

Each of the first memory 222 and the second memory 223 is comprised of ROM, RAM, IC memory card and other semiconductor memories, or a flexible disk, hard disk, magneto-optical disk and other storage devices.

In the first memory 222, a control program to be executed by the central processing unit (CPU) 221 is stored. The central processing unit (CPU) 221 reads the control program from the first memory 222 and controls the operation of the scan driver 23, the scanning pulse driver 24, the sustaining driver 25 and the data driver 26 according to this control program.

In the second memory 223, the potential values and other parameters to be set for each driver are stored.

The drive power supply 21 generates 5V of logic voltage Vdd, about 70V of data voltage Vd and about 170V of sustaining voltage Vs, and generates about 400V of priming voltage Vp, about 100V of scanning base voltage Vbw and about 180V of first bias voltage Vsw1 based on the sustaining voltage Vs.

The logic voltage Vdd is supplied to the controller 22, the data voltage Vd is supplied to the data driver 26, the sustaining voltage Vs is supplied to the scan driver 23 and the sustaining driver 25, and the priming voltage Vp and the scanning base voltage Vbw are supplied to the scan driver 23, and the first bias voltage Vsw1 is supplied to the sustaining driver 25.

The central processing unit (CPU) 221, which is a composing element of the controller 22, generates the scan driver control signals Sscd1 to Sscd6, scanning pulse driver control signals Sspd11 to Sspd1n and Sspd21 to Sspd2n, sustaining driver control signals Ssud1 to Ssud3 and data driver control signals Sdd11 to Sdd1m and Sdd21 to Sdd2m, and supplies the scan driver control signals Sscd1 to Sscd6 to the scan driver 23, the scanning pulse driver control signals Sspd11 to Sspd1n and Sspd21 to Sspd2n to the scanning pulse driver 24, the sustaining driver control signals Ssud1 to Ssud3 to the sustaining driver 25, and the data driver control signals Sdd11 to Sdd1m and Sdd21 to Sdd2m to the data driver 26 respectively, based on video signals Sv supplied from the outside according to the control program stored in the first memory 222.

Figure 3:
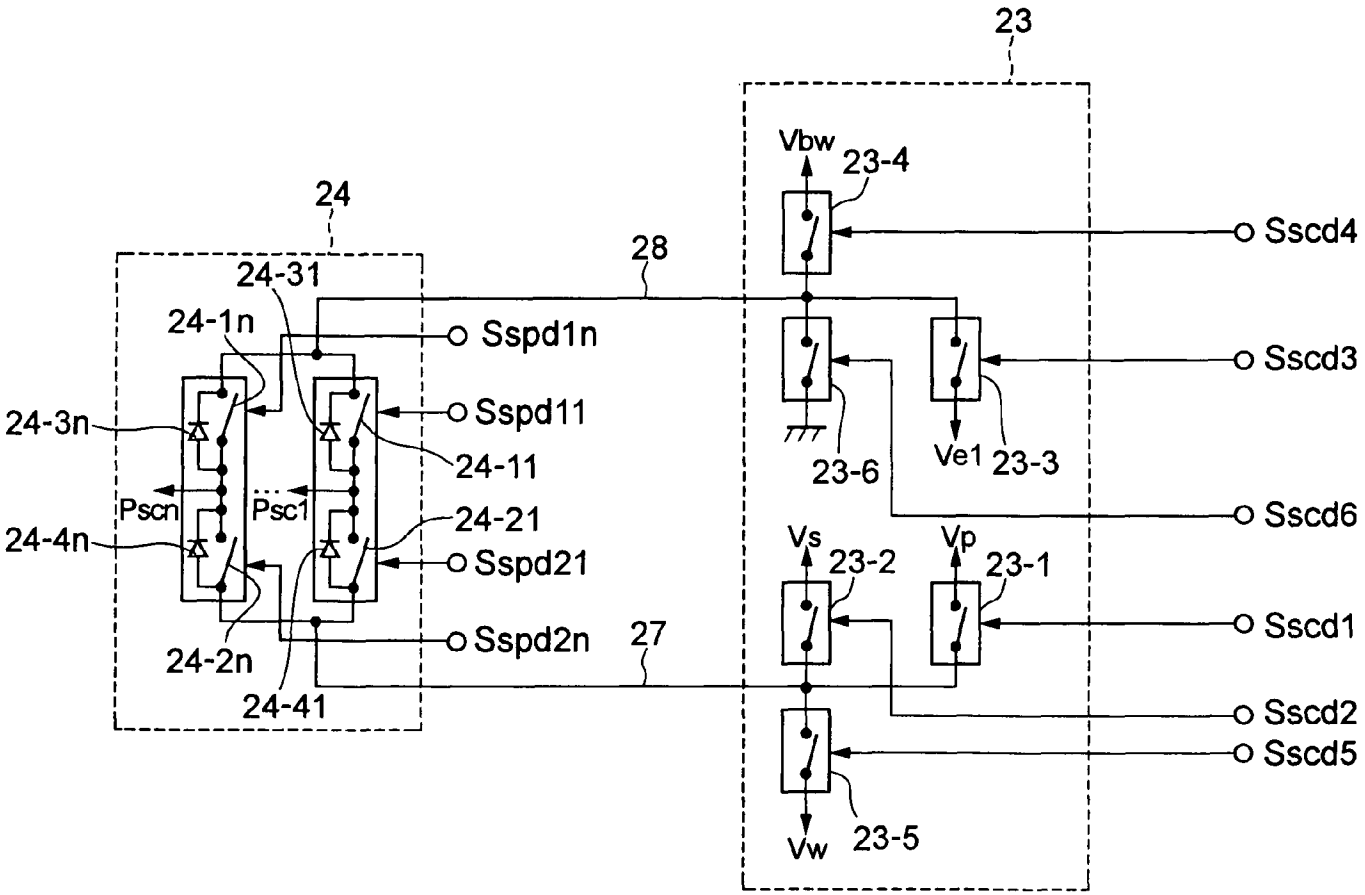
FIG. 3 is a block diagram depicting an example of the scan driver and the scanning pulse driver.

FIG. 3 is a block diagram depicting an example of the structure of the scan driver 23 and the scanning pulse driver 24.

As FIG. 3 shows, the scan driver 23 is comprised of six switches, the first switch 23-1 to the sixth switch 23-6, for example.

The priming voltage Vp is applied to one end of the first switch 23-1, and the other end is connected to the positive line 27. The sustaining voltage Vs is applied to one end of the second switch 23-2, and the other end is connected to the positive line 27. One end of the third switch 23-3 is connected to the voltage Ve1, and the other end is connected to the negative line 28. The scanning base voltage Vbw is applied to one end of the fourth switch 23-4, and the other end is connected to the negative line 28. One end of the fifth switch 23-5 is connected to the voltage Vw, and the other end is connected to the positive line 27. One end of the sixth switch 23-6 is grounded, and the other end is connected to the negative line 28.

The first switch 23-1 to the sixth switch 23-6, of which ON/OFF is switched based on the scan driver control signals Sccd1 to Sscd6, supply voltage with a predetermined waveform to the scanning pulse driver 24 via the positive line 27 or the negative line 28.

The scanning pulse driver 24 is comprised of n number of first switches 24-11 to 24-1n, n number of second switches 24-21 to 24-2n, n number of first diodes 24-31 to 24-3n, and n number of second diodes 24-41 to 24-4n, for example, as shown in FIG. 3.

The first diodes 24-31 to 24-3n are parallel-connected to both ends of the first switches 24-11 to 24-1n respectively and the second diodes 24-41 to 24-4n are parallel-connected to both ends of the second switches 24-21 to 24-2n respectively.

The first switch 24-1a (a: n or smaller natural number) and the second switch 24-2a are cascade-connected, and the other ends of the first switches 24-11 to 24-1n are commonly connected to the negative line 28 respectively, and the other ends of the second switches 24-21 to 24-2n are commonly connected to the positive line 27 respectively.

The connection point of the first switch 24-1a and the second switch 24-2a is connected to the scanning electrode 103-a, which is disposed at the a-th row from the top of the plasma display panel 10.

The first switches 24-11 to 24-1n and the second switches 24-21 to 24-2n switch ON/OFF based on the scanning pulse driver control signals Sspd11 to Sspd1n and Sspd21 to Sspd2n. By this, voltages Psc1 to Pscn with a predetermined waveform are sequentially supplied to the scanning electrodes 103-1 to 103-n.

Figure 4:
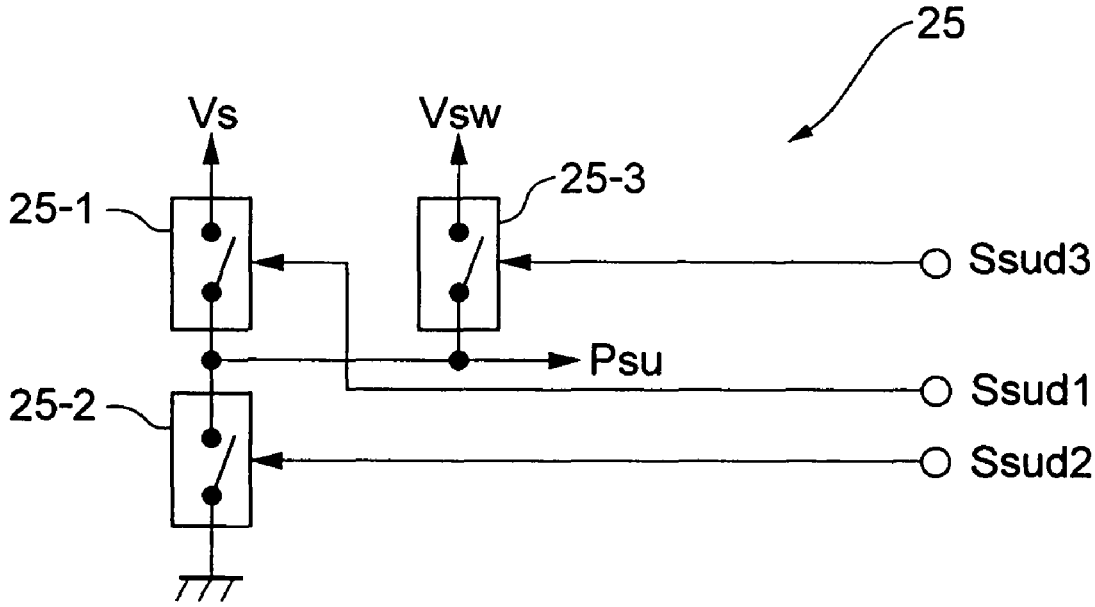
FIG. 4 is a block diagram depicting an example of the sustaining driver.

FIG. 4 is a block diagram depicting an example of the structure of the sustaining driver 25.

As FIG. 4 shows, the sustaining driver 25 is comprised of three switches, the first switch 25-1 to the third switch 25-3, for example.

The sustaining voltage Vs is applied to one end of the first switch 25-1, and the common electrodes 104-1 to 104-n are commonly connected to the other end. One end of the second switch 25-2 is grounded, and the common electrodes 104-1 to 104-n are commonly connected to the other end. Bias voltage Vsw is applied to one end of the third switch 25-3, and common electrodes 104-1 to 104-n are commonly connected to the other end.

The first switch 25-1 to the third switch 25-3, of which ON/OFF is switched based on the sustaining driver control signals Ssud1 to Ssud3 respectively, supply voltage Psu with a predetermined waveform to the common electrodes 104-1 to 104-n.

Figure 5:
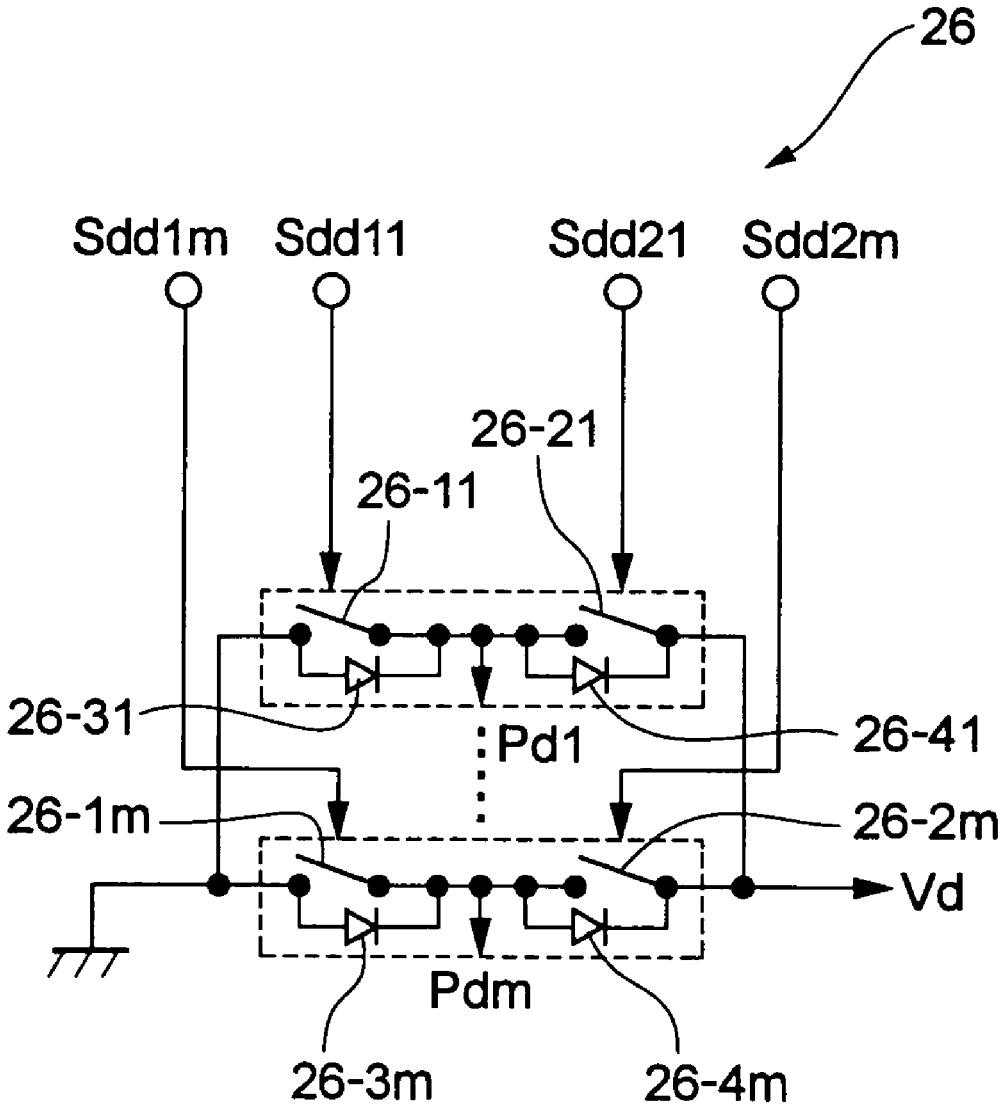
FIG. 5 is a block diagram depicting an example of the configuration of the data driver.

FIG. 5 is a block diagram depicting an example of the configuration of the data driver 26.

As FIG. 5 shows, the data driver 26 is comprised of m number of first switches 26-11 to 26-1m, m number of second switches 26-21 to 26-2m, m number of first diodes 26-31 to 26-3m, and m number of second diodes 26-41 to 26-4m, for example.

The first diodes 26-31 to 26-3m are parallel-connected to both ends of the first switches 26-11 to 26-1m respectively, and the second diodes 26-41 to 26-4m are parallel-connected to both ends of the second switches 26-21 to 26-2m respectively.

The first switch 26-1b (b: m or smaller natural number) and the second switch 26-2b are cascade-connected, and the other ends of the first switches 26-11 to 26-1m are commonly connected to the ground respectively, and data voltage Vd is supplied to the other ends of the second switches 26-21 to 26-2m respectively.

The connection point of the first switch 26-1b and the second switch 26-2b is connected to the data electrode 107-b disposed at the b-th column from the left of the plasma display panel 10.

The first switches 26-11 to 26-1m and the second switches 26-21 to 26-2m, of which ON/OFF is switched based on the data driver control signals Sdd11 to Sdd1m and Sdd21 to Sdd2m respectively, sequentially supply the voltages Pd1 to Pdm with a predetermined waveform to the data electrodes 107-1 to 107-m respectively.

Figure 6:
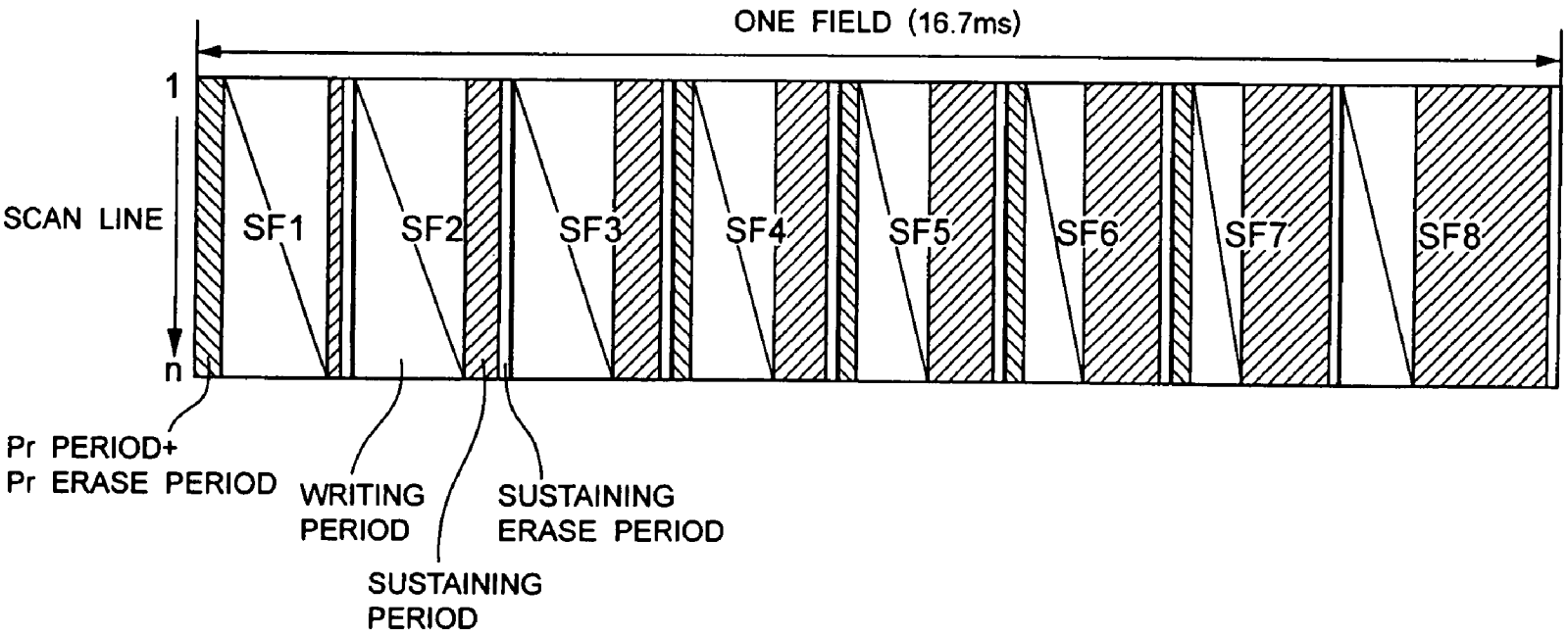
FIG. 6 is a diagram depicting the drive sequence in the plasma display device according to the first embodiment of the present invention.

FIG. 6 shows the drive sequence in the plasma display device 1 according to the present embodiment.

As FIG. 6 shows, in the plasma display device 1 according to the present embodiment, one field (16.7 ms) is divided into eight sub-fields SF1-SF8, and of these the priming period and the priming erase period are not set in the second, third and eighth sub-fields, SF2, SF3 and SF8. In other words, the sub-fields SF2, SF3 and SF8 are set as "Pr skipped SF".

In this way, in the plasma display panel device 1 according to the present embodiment, two Pr skipped SFs are continuously set (SF2 and SF3). In such a case, operation with the setup voltage involves difficulty in a conventional plasma display panel device, but this problem is solved, as described below, in the plasma display panel device 1 according to the present embodiment.

Figure 7:
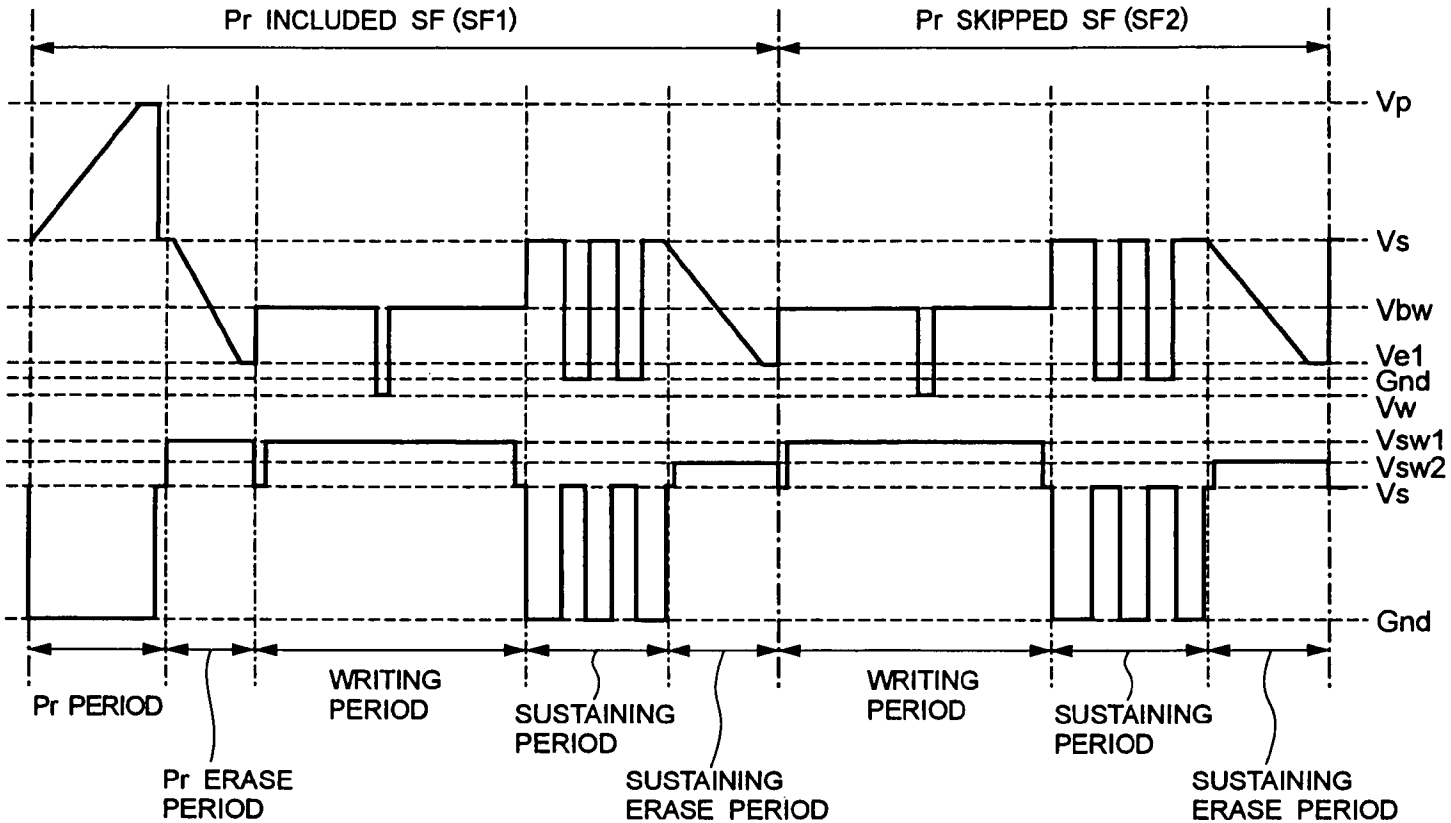
FIG. 7 is a timing chart depicting the writing select type drive operation of the plasma display panel in the plasma display device according to the first embodiment of the present invention, and shows the timing chart in the sub-field SF1 and sub-field SF2 in FIG. 6.

FIG. 7 is a timing chart depicting the writing select type drive operation of the plasma display panel 10 in the plasma display device 1 according to the present embodiment, and shows the timing chart in the sub-field SF1 and sub-field SF2 shown in FIG. 6.

In the priming period, the central processing unit (CPU) 221 of the controller 22 starts generating the scan driver control signals Sscd1 to Sscd6, sustaining driver control signals Ssud1 to Ssud3, and scanning pulse driver control signals Sspd11 to Sspd1n and Sspd21 to Sspd2n based on the video signal Sv supplied from the outside, and also starts generating the data drive control signals Sdd11 to Sdd1m at a level based on the video signal Sv, and data driver control signals Sdd21 to Sdd2m at low level, and supplies se control signals to each driver 23, 25, 24 and 26.

As a result, in the priming period, the switch 23-1 is turned ON by the scan driver control signal Sscd1 at high level, and the switch 25-2 is turned ON by the sustaining driver control signal Ssud2 at high level. Therefore as FIG. 7 shows, the saw tooth wave priming pulse Ppr-s with positive polarity is applied to all the scanning electrodes 103-1 to 103-n and rectangular wave priming pulse Ppr-c with negative polarity is applied to all the common electrodes 104-1 to 104-n.

Figure 28:
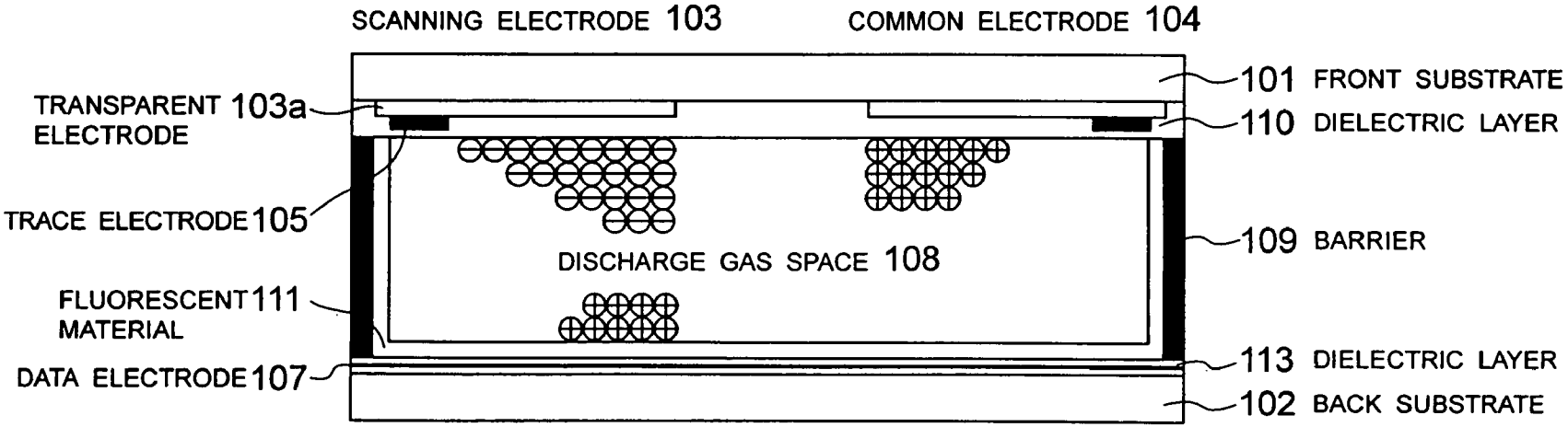
FIG. 28 is a diagram depicting the wall charge generation status during the writing select type drive operation of the plasma display panel shown in FIG. 25.

Because of this, in all the display cells, a priming charge is generated in the discharge gas space 108 near the electrode gap between the scanning electrodes 103-1 to 103-n and the common electrodes 104-1 to 104-n. By this, active particles, which make it easier to generate the writing charge of the display cells, are generated in the discharge gas space 108, wall charges with negative polarity are attached to the scanning electrodes 103-1 to 103-n, wall charges with positive polarity are attached to the common electrodes 104-1 to 104-n, and wall charges with positive polarity are attached on the data electrodes 107-1 to 107-m (see FIG. 28).

Then the switch 25-2 turns OFF by the sustaining driver control signals Ssud2 falling to low level and switch 25-1 turns ON by the sustaining driver control signal Ssud1 rising to high level. Then the switch 23-2 turns OFF by the scan driver control signal Sscd2 falling, and the switch 23-3 turns ON by the scan driver control signal Sscd3 rising. Therefore after the potentials of all the common electrodes 104-1 to 104-n are held at about 170V of sustaining voltage Vs, a saw tooth priming erase pulse Ppe-s is applied to all the scanning electrodes 103-1 to 103-n and rectangular wave pulse Ppe-c with a first bias potential Vsw1 is applied to all the common electrodes 104-1 to 104-n in the priming erase period.

Figure 29:
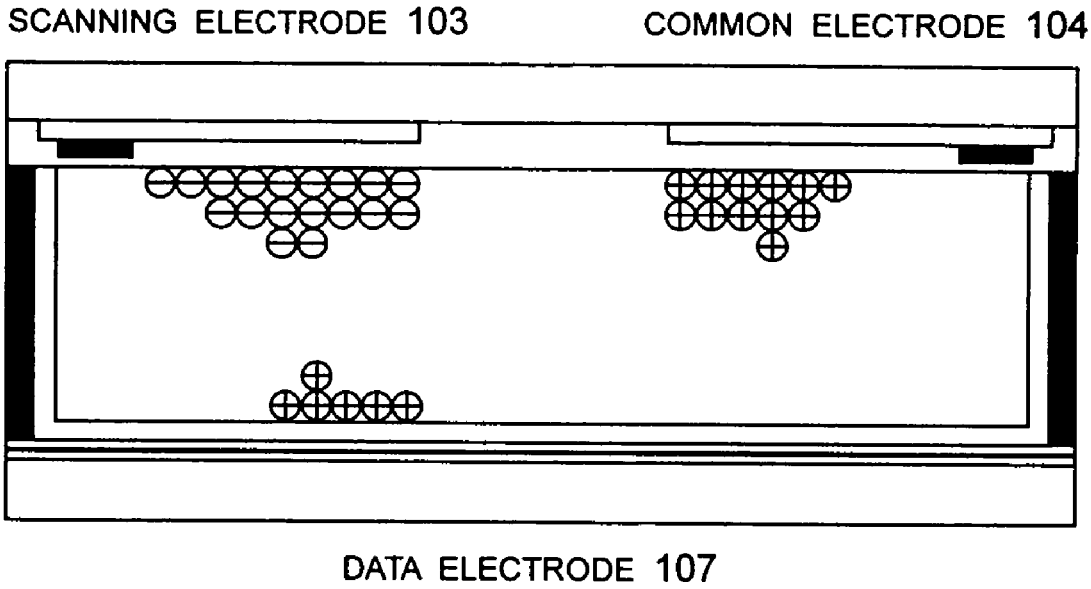
FIG. 29 is a diagram depicting the wall charge generation status during the writing select type drive operation of the plasma display panel shown in FIG. 25.

Because of this, a weak discharge is generated in all the display cells. And by this, wall charges with negative polarity near the scanning electrodes 103-1 to 103-n and wall charges with positive polarity near the common electrodes 104-1 to 104-n and wall charges with positive polarity near the data electrodes 107-1 to 107-m decrease (see FIG. 29).

Then in the writing period, the switch 25-3 turns ON by the sustaining driver control signal Ssud3 at high level, and the switches 23-4 and 23-5 turn ON by the scan driver control signals Sscd4 and Sscd5 at high level being supplied since the priming period. Therefore the bias pulse Pw-c with positive polarity (first bias voltage Vsw1) is applied to all the common electrodes 104-1 and 104-n and the potentials of the pulses Psc1 to Pscn to be applied to all the scanning electrodes 103-1 to 103-n are held once at the scanning base voltage Vbw.

In this status, the switches 24-11 to 24-1n are sequentially turned OFF and the switches 24-21 to 24-2n are sequentially turned ON by sequentially lowering the scanning pulse driver control signals Sspd11 to Sspd1n to low level, and sequentially raising the scanning pulse driver control signals Sspd21 to Sspd2n to high level accordingly. Also synchronizing this, the switches 26-11 to 26-1m are turned ON and the switches 26-21 to 26-2m are turned OFF based on the video signal Sv by raising the data driver control signals Sdd11 to Sdd1m to high level based on the video signal Sv and lowering the data driver control signals Sdd21 to Sdd2m accordingly.

Therefore if writing is performed in the display cell at the a-th row and the b-th column, the scanning pulse Pw-sn with negative polarity is applied to the scanning electrode 103-a, and the data pulse Pw-d with positive polarity is applied to the data electrode 107-b at the b-th column.

Figure 30:
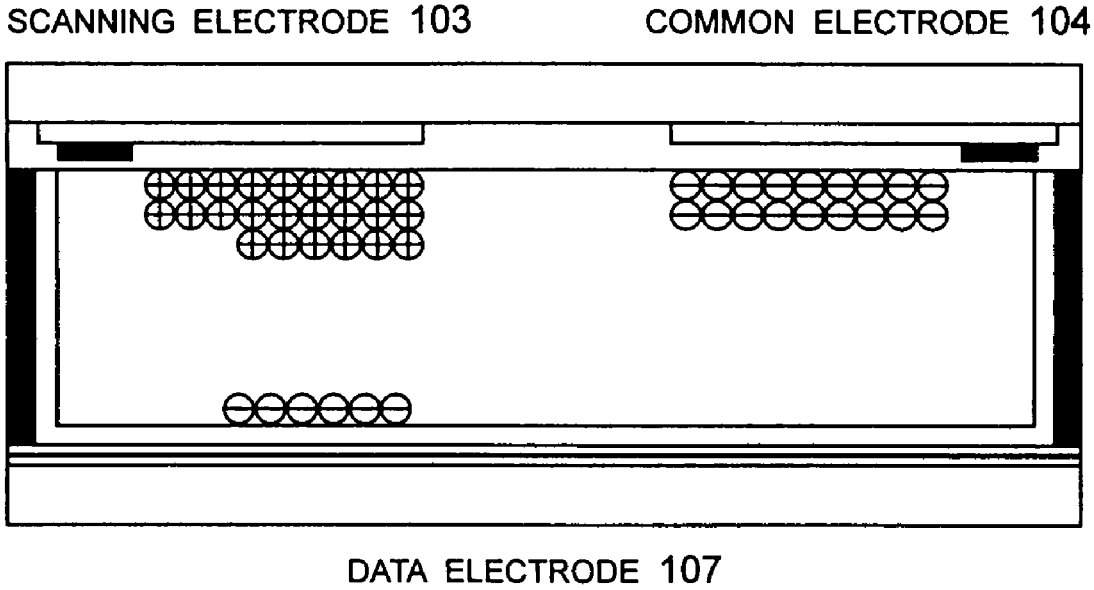
FIG. 30 is a diagram depicting the wall charge generation status during the writing select type drive operation of the plasma display panel shown in FIG. 25.

As a result, a counter discharge is generated in the display cell at the a-th row and b-th column, and triggered by this counter discharge, a surface discharge is generated between the scanning electrode 103 and the common electrode 104 as the writing discharge, and wall charges are attached to each electrode (see FIG. 30).

Whereas in the display cells where a writing discharge was not generated, there are few wall charges that remain in this state after erasing the charges of the priming period.

Then in the sustaining period, the scan driver control signals Sscd2 and Sscd6 repeat an alternate rise/fall for the number of times according to the sub-field. As a result, the switches 23-2 and 23-6 repeat an alternate ON/OFF. Synchronizing this, the sustaining driver control signals Ssud1 and Ssud2 also repeat an alternate rise/fall for the number of times according to the sub-field. As a result, the switches 25-1 and 25-2 repeat an alternate ON/OFF.

Because of this, the sustaining pulse Psus-s with negative polarity is applied to all the scanning electrodes 103-1 to 103-n for the number of times according to the sub-field, and the sustaining pulse Psus-c with negative polarity is applied to all the common electrodes 104-1 to 104-n for the number of times according to the sub-field exclusively from the sustaining pulses Psus-s.

Figure 31:
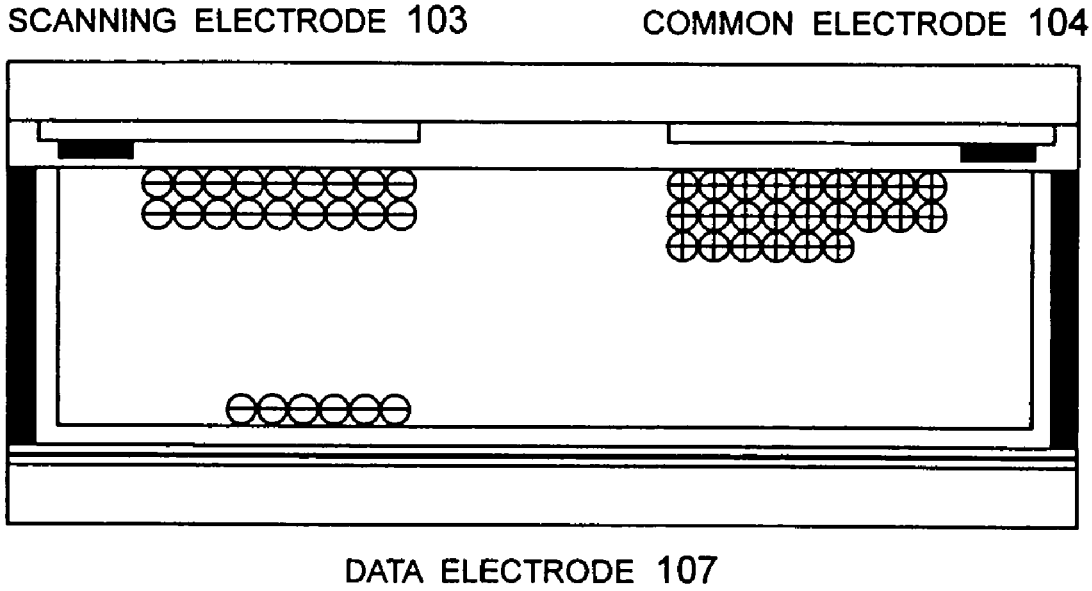
FIG. 31 is a diagram depicting the wall charge generation status during the writing select type drive operation of the plasma display panel shown in FIG. 25.
Figure 32:
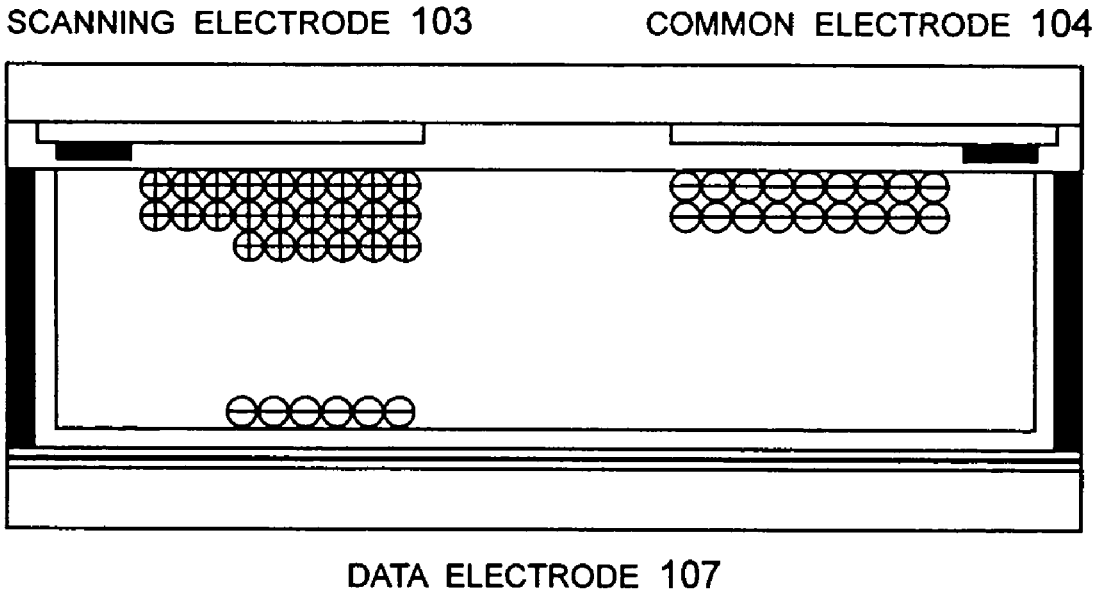
FIG. 32 is a diagram depicting the wall charge generation status during the writing select type drive operation of the plasma display panel shown in FIG. 25.
Figure 33:
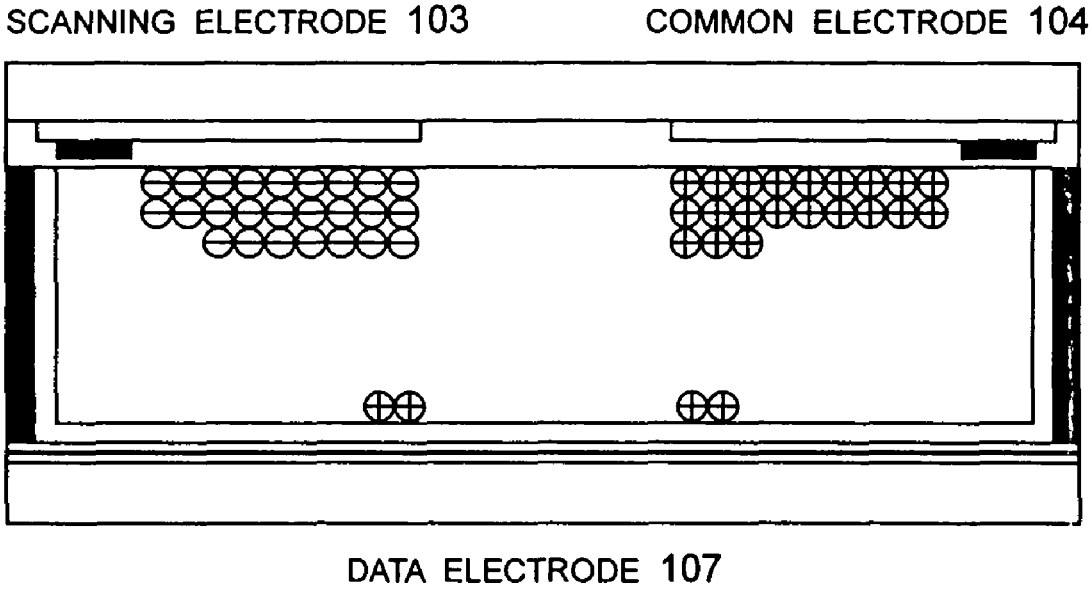
FIG. 33 is a diagram depicting the wall charge generation status during the writing select type drive operation of the plasma display panel shown in FIG. 25.
Figure 34:
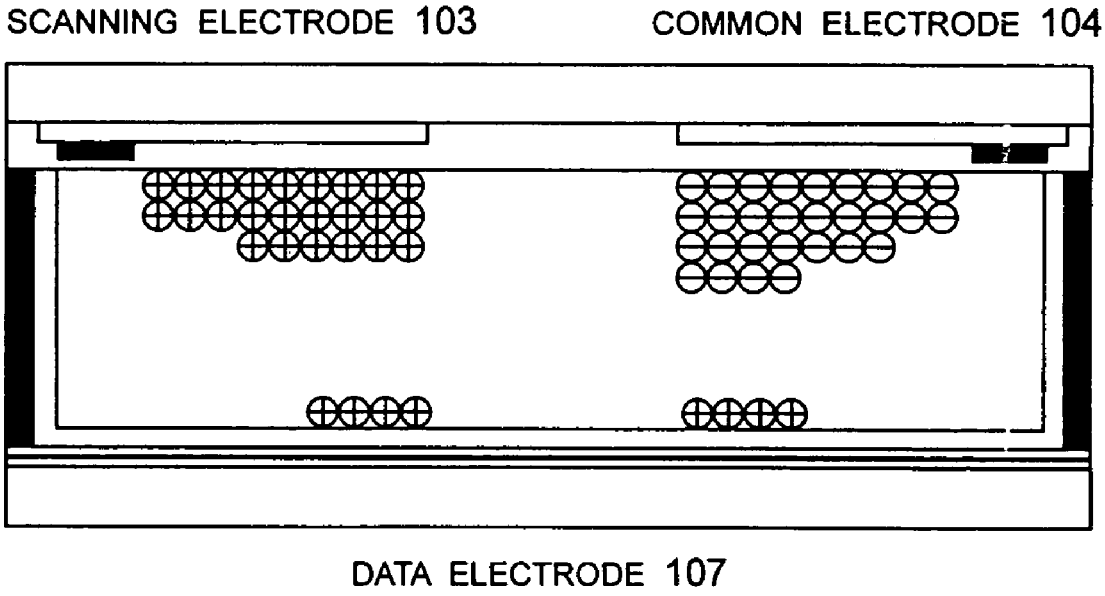
FIG. 34 is a diagram depicting the wall charge generation status during the writing select type drive operation of the plasma display panel shown in FIG. 25.
Figure 35:
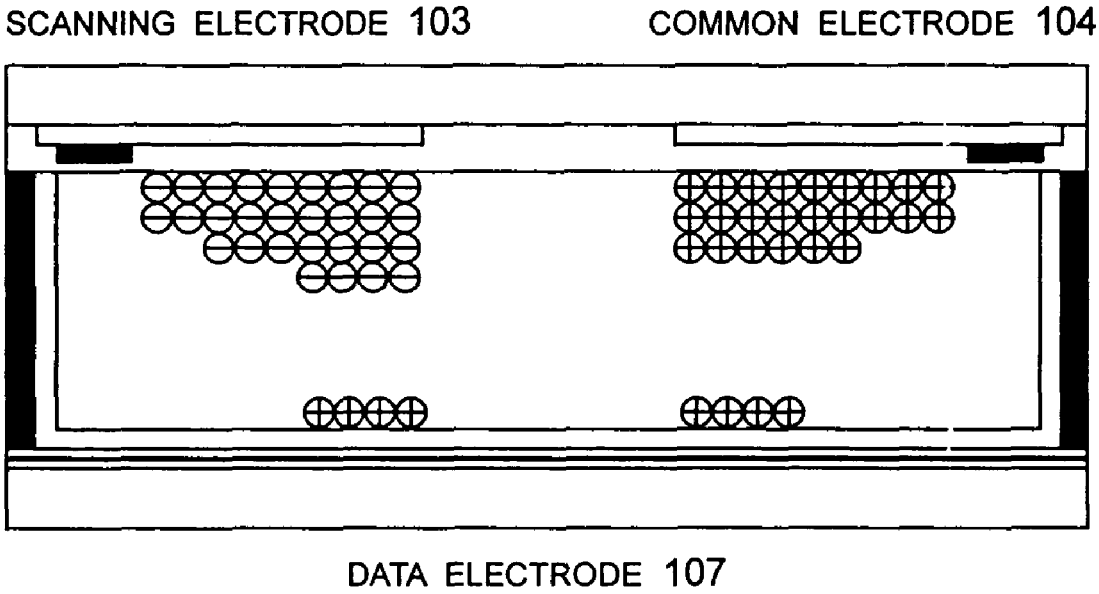
FIG. 35 is a diagram depicting the wall charge generation status during the writing select type drive operation of the plasma display panel shown in FIG. 25.

By this, the amount of wall charges of the display cells where a writing discharge was not generated in the writing period remain extremely low, so a sustaining discharge is not generated even if a sustaining pulse is applied to the display cell. On the other hand, in the display cells where a writing discharge was generated in the writing period, the wall charges with positive polarity are attached on the scanning electrode 103 and the wall charges with negative polarity are attached on the common electrode 104, so the sustaining pulse and the wall charge voltage are superimposed on each other, and the voltage between the scanning electrode 103 and the common electrode 104 exceeds the discharge start voltage, and a surface discharge is generated (see FIG. 31).

Then in the sustaining erase period, the switch 23-3 turns ON by the scan driver control signal Sscd3 rising. As a result, the saw tooth charge erase pulse Pse-s with negative polarity is applied to all the scanning electrodes 103-1 to 103-n. On the other hand, the rectangular wave pulse Pse-c which has positive polarity at the second bias potential Vsw2 is applied to the common electrodes 104-1 to 104-n. As a result, a weak discharge is generated in all the display cells. By this, wall charges stored near the scanning electrode 103 and the common electrode 104 in the display cells which were emitted in the sustaining period are erased, and the charge status of all the display cells are equalized.

The differences between the timing chart of the plasma display panel 1 according to the present embodiment (FIG. 7) and the timing chart of the conventional plasma display panel where the Pr skipped SF is set (FIG. 38) are as follows.

Figure 38:
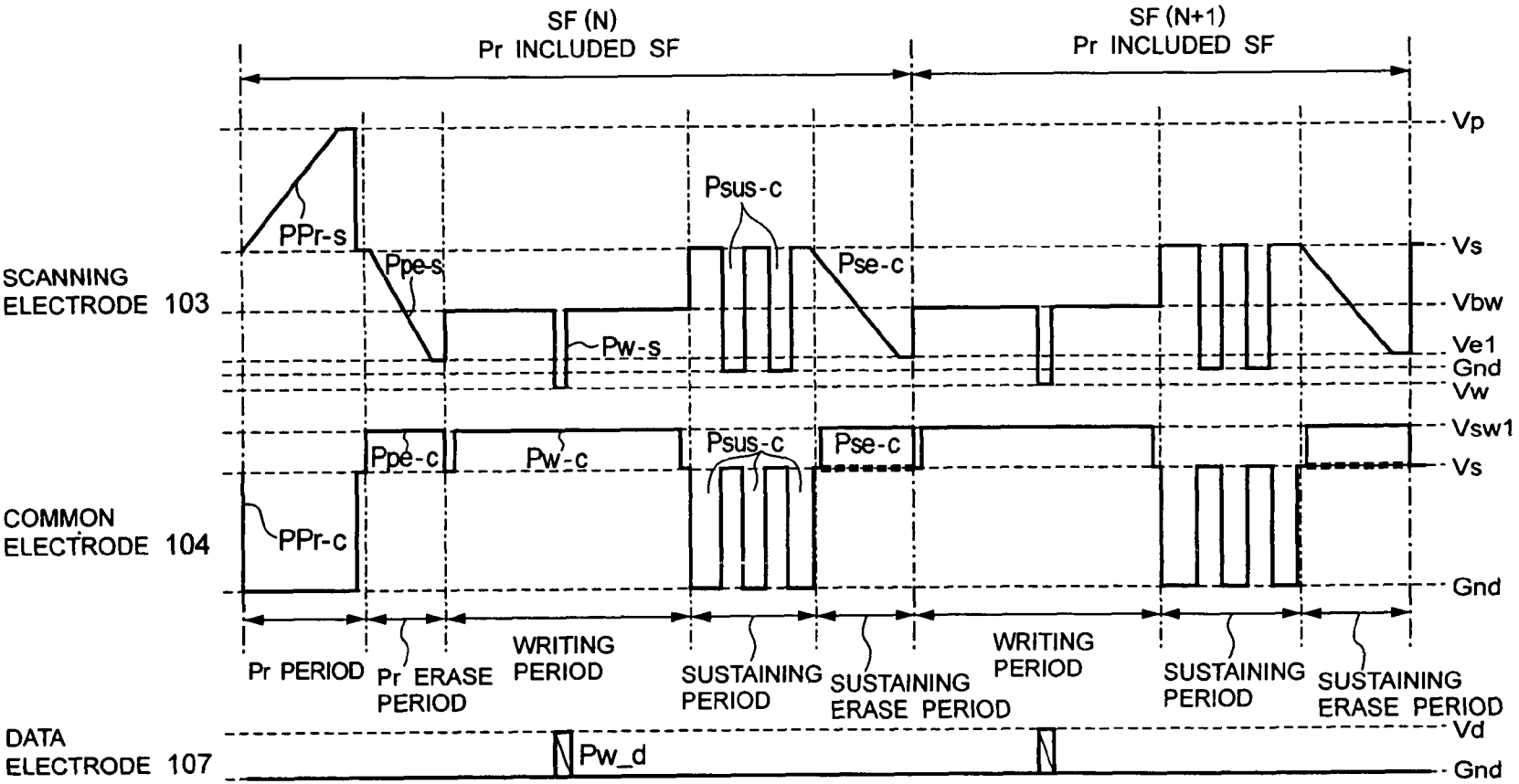
FIG. 38 is a timing chart depicting the writing select type drive operation of a conventional plasma display panel in which Pr skipped SF is set.

As FIG. 38 shows, in the conventional plasma display, the first bias potential Vsw1 is applied to the common electrode 104 in the sustaining erase period. On the other hand, in the plasma display panel 1 according to the present embodiment, the second bias potential Vsw2 is applied to the common electrode 104 in the sustaining erase period in both the sub-field SF1 (sub-field where the priming period and the priming erase period are set) and the sub-field SF2 (Pr skipped SF, that is sub-field where the priming period and the priming erase period are not set).

When the ultimate potential (or attained potential) of the saw tooth charge erase pulse Pse-s to be applied to the scanning electrode 103 in the sustaining erase period is assumed to be Ve1, the surface potential difference (Vsw2−Ve1), which is the potential difference between the scanning electrode 103 and the common electrode 104, is set to be smaller than the surface potential difference (Vsw1−Vw) in the writing period of the sub-field SF1, which is a Pr skipped SF. This is expressed by the following inequality:

$$(Vsw2-Ve1)<(Vsw1-Vw). \quad (1)$$

The second bias potential Vsw2 is set to be higher than the sustaining voltage Vs and lower than the first bias potential Vsw1. This is expressed by the following inequality:

$$Vs<Vsw2<Vsw1. \quad (2)$$

In the plasma display panel 1 according to the present embodiment, the potential of the common electrode 104 in the sustaining erase period of the Pr skipped SF (Sub-field SF2) is set to the second bias potential Vsw2, but if the sub-fields SF after the Pr skipped SF (sub-field SF2) is a normal sub-field SF (sub-field where the priming period and the priming erase period are set), the priming potential is applied to this normal sub-field SF, so the potential of the common electrode 104 in the sustaining erase period of the Pr skipped SF (sub-field SF2) may be set to the first bias potential Vsw1. If the Pr skipped SFs continue, as shown in the sub-fields SF2 and SF3 in FIG. 6, however, the potential to be applied to the common electrode 104 in the sustaining erase period in the sub-field SF2 must be set to the second bias potential Vsw2.

Figure 8:
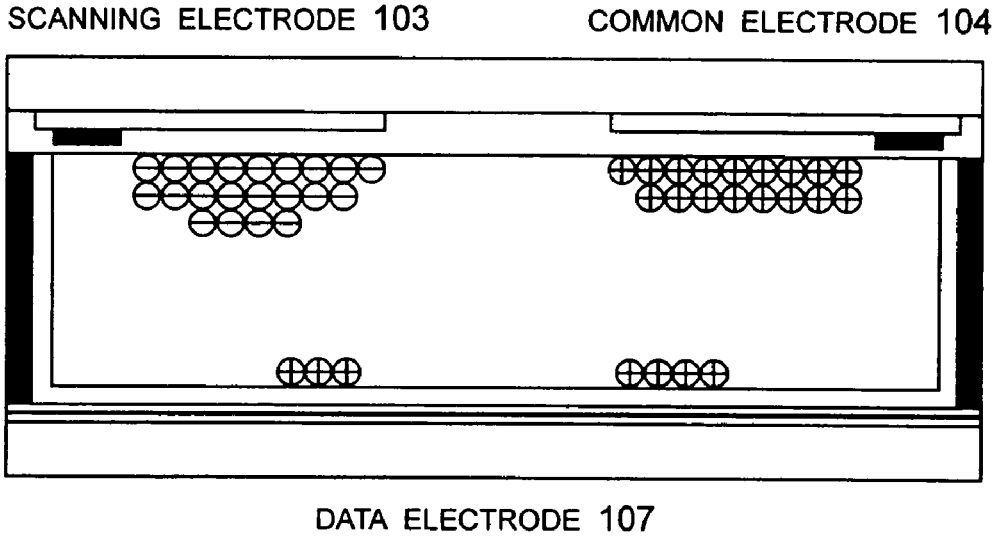
FIG. 8 is a diagram depicting the amount of the wall charges stored in the scanning electrode and the common electrode according to the first embodiment of the present invention.

FIG. 8 shows the status of wall charges after the sustaining erase period completes in the case when a Pr included SF (sub-field SF1) is selected in the plasma display panel 1 according to the first embodiment.

Compared with the surface potential difference (Vs−Ve1) and (Vsw1−Ve1), which is the potential difference between the scanning electrode 103 and the common electrode 104 in the sustaining erase period of the conventional plasma display, the surface potential difference (Vsw2−Ve1), which is the potential difference between the scanning electrode 103 and the common electrode 104 in the sustaining erase period, becomes as follows according to Expression (1).

$$(Vs-Ve1)<(Vsw2-Ve1)<(Vsw1-Ve1). \quad (3)$$

Figure 36:
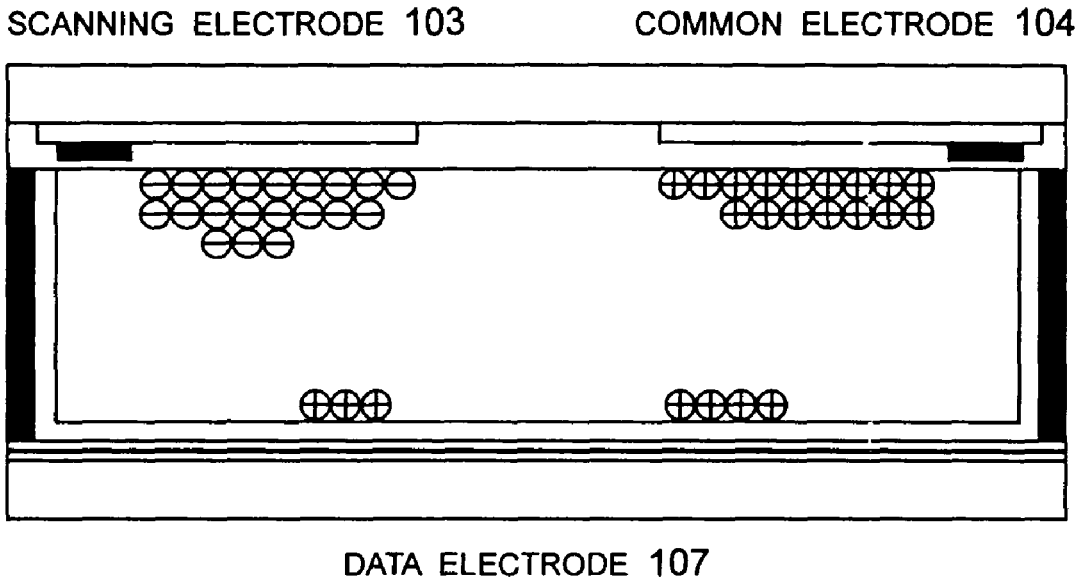
FIG. 36 is a diagram depicting the wall charge generation status during the writing select type drive operation of the plasma display panel shown in FIG. 25.
Figure 37:
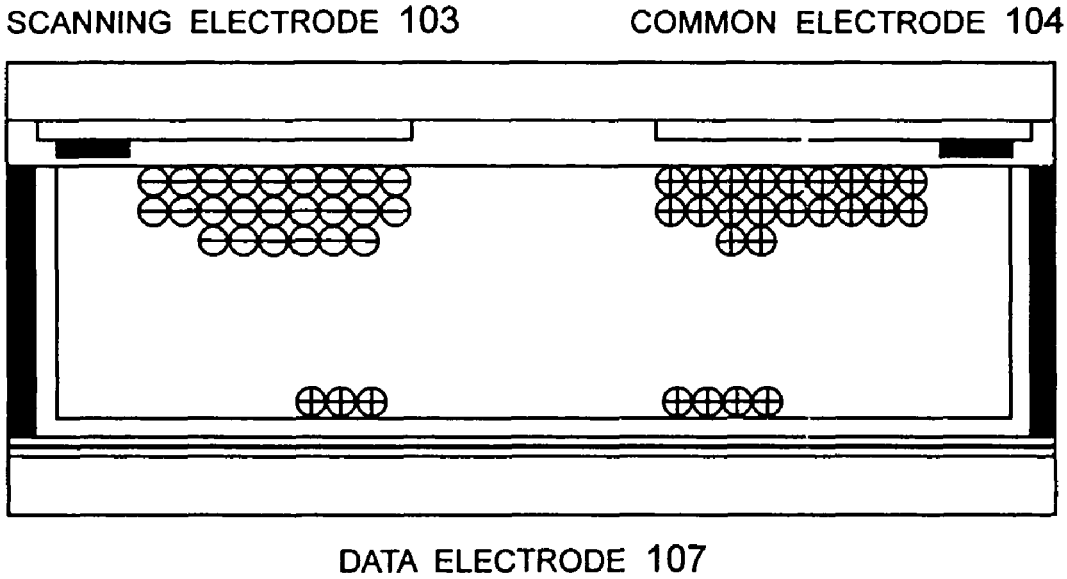
FIG. 37 is a diagram depicting the wall charge generation status during the writing select type drive operation of the plasma display panel shown in FIG. 25.

The amount of wall charges to be erased is in proportion to the surface potential difference, so as the comparison of FIG. 8, FIG. 36 and FIG. 37 shows, the amount of wall charges stored between the scanning electrode 103 and the common electrode 104 according to the present embodiment (FIG. 8) is more than the amount of wall charges stored between the scanning electrode 103 and the common electrode 104 in the case when the potential of the common electrode 104 is the first bias potential Vsw1 in the conventional plasma display panel (FIG. 36), and is less than the amount of wall charges stored between the scanning electrode 103 and the common electrode 104 in the case when the potential of the common electrode 104 is the first bias potential Vs in the conventional plasma display panel (FIG. 37). (As described above, the amount of wall charges is shown by the number of wall charges in each drawing to show comparison.)

According to the plasma display device of the present embodiment, wall charges are generated near the scanning electrode 103 and the common electrode 104 in the sustaining erase period of the Pr skipped SF (sub-field SF2) of the plasma display panel 10 so that Expressions (2) or (3) establishes, therefore the problem of the conventional plasma display panel, that is the increase of the minimum value Vd_min of the data voltage Vd and the minimum value Vsw1_min of the first bias potential Vsw1 and the drop of the maximum value Vs_max of the sustaining voltage Vs, can be suppressed, and the drive margin can be increased. As a result, when the so called stretch out coding is used, Pr skipped SFs can be continuously set, and the number of Pr skipped SFs can be increased more so than the case of the conventional plasma display panels. As a result, the black brightness can be decreased.

The present embodiment is effective when the counter discharge is not generated between the data electrode 107 and the scanning electrode 103 during sustaining erase discharge.

According to the first embodiment, three Pr skipped SFs, SF2, SF3 and SF8 were set as shown in FIG. 6, but the number of Pr skipped SFs and the locations thereof are not limited to this. Any number of Pr skipped SFs can be set after the normal sub-field SF.

In the present embodiment, the second bias potential Vsw2 is set to be higher than the sustaining voltage Vs and lower than the first bias potential Vsw1 (see Expression (2)), but it is not always necessary to set the second bias potential Vsw2 to be lower than the first bias potential Vsw1 as long as the surface potential difference (Vsw2−Ve1), which is the potential difference between the scanning electrode 103 and the common electrode 104, is set to be smaller than the surface potential difference (Vsw1−Vw) in the writing period of the sub-field SF1, which is a Pr skipped SF (see Expression (1)).

Second Embodiment

Figure 9:
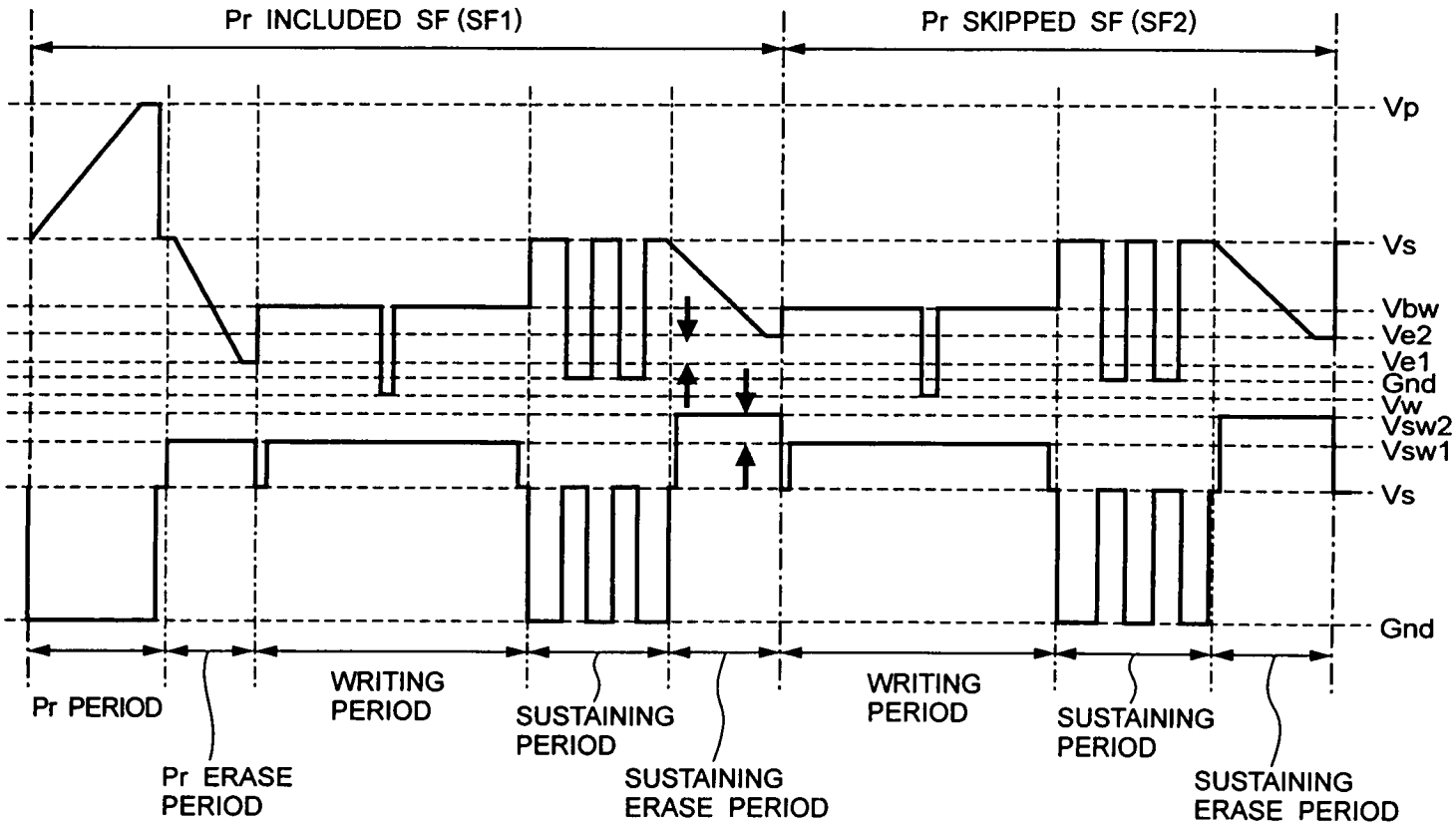
FIG. 9 is a timing chart of the plasma display panel in the plasma display device according to the second embodiment of the present invention.

FIG. 9 is a timing chart of the plasma display panel in the plasma display drive according to the second embodiment.

The plasma display device according to the second embodiment has the same structure as the plasma display device according to the first embodiment, but the potentials, which are set for the scanning electrode 103 and the common electrode 104 by the central processing unit (CPU) 221 of the controller 22, are different from the potentials in the conventional plasma display panel (see FIG. 38), as described herein below.

According to the present embodiment, in the sustaining erase period of the normal sub-field SF1 (sub-field where the priming period and the priming erase period are set) just before the Pr skipped SF (sub-field SF2), the second bias potential Vsw2 to be applied to the common electrode 104 is set to be higher than the first bias potential Vsw1 to be applied to the common electrode 104 in the writing period. This is expressed by the following inequality:

$$Vsw2>Vsw1. \quad (4)$$

Also in the sustaining erase period, the ultimate potential Ve2 of the saw tooth charge erase pulse Pse-s to be applied to the scanning electrode 103 is set to be higher than the ultimate potential Ve1 of the charge erase pulse Pse-s of the first embodiment. This is expressed by the following inequality:

$$Ve2>Ve1. \quad (5)$$

As mentioned above, the polarity of the wall charges stored near the data electrode 107 and the amount of the wall charges may be different between the beginning and the end of the sustaining period depending on the number of sustaining pulses. The second embodiment is effective when the number of sustaining pulses is high, and the wall charges with positive polarity are stored near the data electrode 107.

In the case of the conventional plasma display panel, wall charges with negative polarity are stored near the scanning electrode 103 and wall charges with positive polarity are stored near the data electrode 107 respectively after the final sustaining discharge completes, so as the sustaining erase pulse Ppe-s drops, a counter charge with the scanning electrode 103 as the cathode is generated. If the counter discharge is generated, wall charges with positive polarity to be stored near the data electrode 107 decreases. If the wall charges with positive polarity near the data electrode 107 decreases, it becomes difficult for the counter discharge between the scanning electrode 103 and the data electrode 107 to be generated in the writing period in the Pr skipped SF, and the minimum value Vd_min of the data voltage Vd and the minimum value Vsw1_min of the first bias potential Vsw1 increase.

To prevent this problem, the decrease of the wall charges with positive polarity to be stored near the data electrode 107 must be prevented, and for this the counter discharge must be suppressed. For this goal, according to the second embodiment, the ultimate potential of the sustaining erase pulse Pse-s, just before the Pr skipped SF (sub-field SF2), is set to Ve2 (Ve2>Ve1), and the counter potential difference between the scanning electrode 103 and the data electrode 107 is increased.

Figure 10:
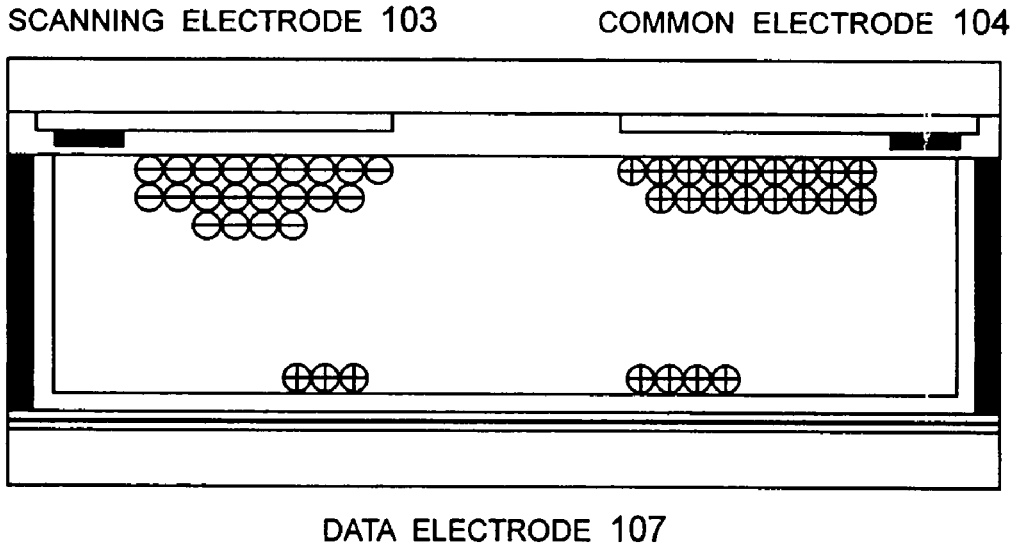
FIG. 10 is a diagram depicting the amount of the wall charges stored near the scanning electrode and the common electrode according to the second embodiment of the present invention.

Also just like the first embodiment, the surface potential difference during sustaining erase is set as to establish the above Expression (3). By setting this potential relationship, the wall charges shown in FIG. 10 are generated.

By this, the wall charges with positive polarity to be stored near the data electrode 107 increase more than the first embodiment (4 in the present embodiment (FIG. 10), while 3 in the first embodiment (FIG. 8)), the minimum value Vd_min of the data voltage Vd and the minimum value Vsw1_min of the first bias potential Vsw1 decrease more than the first embodiment, and the drive margin can be increased.

The second embodiment is effective when the counter discharge is generated between the data electrode 107 and the scanning electrode 103 during sustaining erase discharge.

In the present embodiment, it is preferable that the increased width of the bias potential (Vsw2−Vsw1) to be applied to the common electrode 104 is equal with the increased width of the ultimate potential of the sustaining erase pulse Pse-s (Ve2−Ve1) to be applied to the scanning electrode 103. This is expressed by the following inequality:

$$Vsw2-Vsw1=Ve2-Ve1. \quad (6)$$

By this, the surface potential difference between the scanning electrode 103 and the common electrode 104 is maintained at a predetermined value.

Third Embodiment

Figure 11:
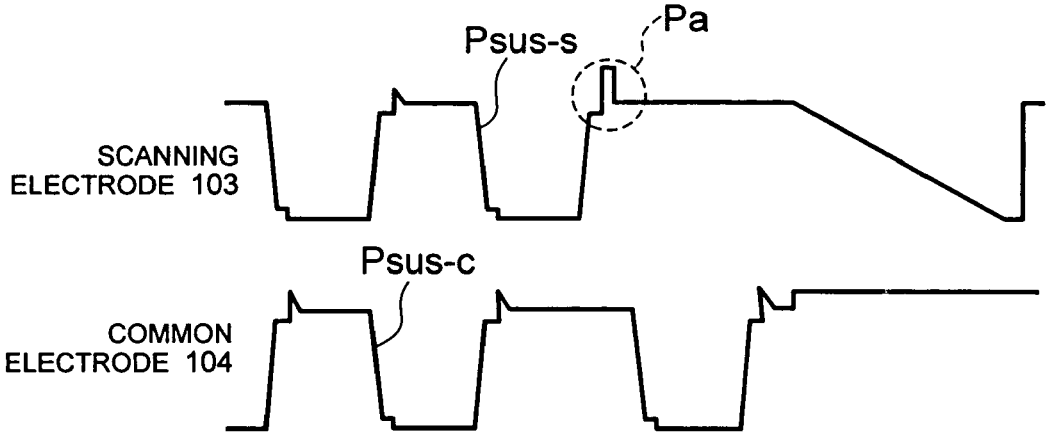
FIG. 11 is a part of the timing chart of the plasma display panel in the plasma display device according to the third embodiment of the present invention.

FIG. 11 is a part of the timing chart of the plasma display panel in the plasma display device according to the third embodiment. FIG. 11 is a partial enlarged view of each pulse to be applied to the scanning electrode 103 and the common electrode 104 in the sustaining period.

The plasma display device according to the third embodiment has the same structure as the plasma display device according to the first embodiment, but the potentials which are set for the scanning electrode 103 and the common electrode 104 by the central processing unit (CPU) 221 of the controller 22 are different from the potentials in the conventional plasma display panel (see FIG. 38), as described herein below.

Unlike the conventional plasma display panel, according to the present embodiment, an auxiliary pulse Pa, which has a potential higher than the potential Vs of the sustaining pulse Psus-s, is added to one sustaining pulse of the plurality of sustaining pulses Psus-s to be applied to the scanning electrode 103 in the sustaining period. In the case of the present embodiment, the auxiliary pulse Pa is added to the final sustaining pulse of the plurality of sustaining pulses Psus-s.

As described in the second embodiment, the minimum value Vd_min of the data voltage Vd and the minimum value Vsw1_min of the first bias potential Vsw1 can be decreased more as the wall charges with positive polarity to be stored near the data electrode 107 increase.

If the number of sustaining pulses is small, as described above, the wall charges with negative polarity may be stored near the data electrode 107. If the wall charges with negative polarity are stored, the wall voltage is decreased by the wall charges, and it becomes difficult to generate a counter discharge during writing, so the minimum value Vd_min of the data voltage Vd increases.

Figure 12:
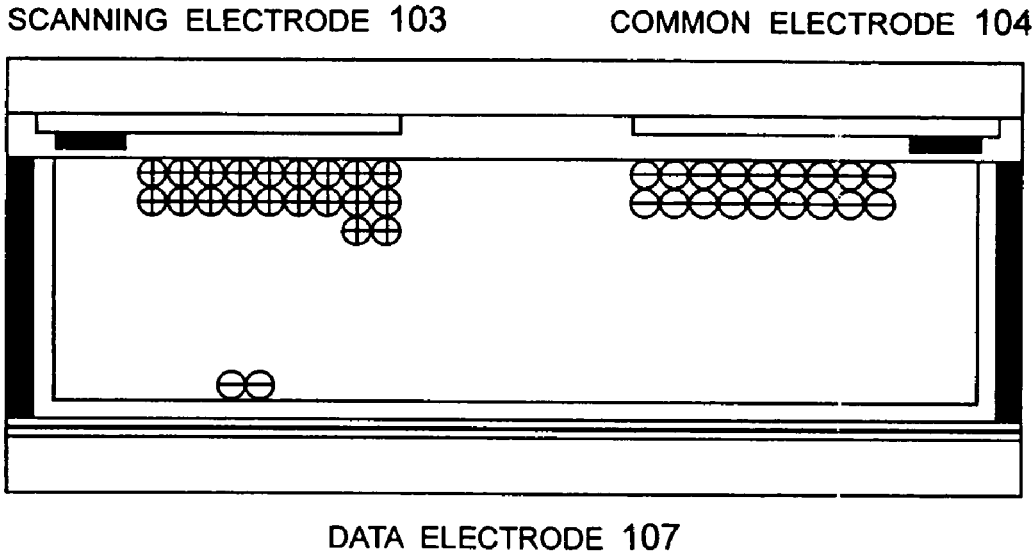
FIG. 12 is a diagram depicting the amount of the wall charges stored near the scanning electrode and the common electrode according to the third embodiment of the present invention.

To solve this problem, it is necessary to remove the wall charges with negative polarity near the data electrode 107. This is because, depending on the first and second sustaining pulses to be applied the first and second time on the scanning electrode 103, a counter discharge cannot be generated since wall charges with positive polarity stored near the scanning electrode 103 are few. In order to generate the counter discharge, an auxiliary pulse higher than the sustaining pulse voltage Vs is applied. By applying such an auxiliary pulse Pa, the counter discharge is generated between the scanning electrode 103 and the data electrode 107, and the wall charges with negative polarity near the data electrode 107, which positions below the scanning electrode 103, decrease, as shown in FIG. 12. By this, an increase of the minimum value Vd_min of the data voltage Vd can be suppressed.

In this way, the present embodiment is effective when the number of sustaining cycles of the Pr included SF (sub-field SF1) before the Pr skipped SF (sub-field SF2) is small, that is, when the wall charges with negative polarity are stored near the data electrode 107.

The auxiliary pulse Pa can be generated by newly creating an auxiliary pulse generation circuit, for example.

Or the auxiliary pulse Pa can also be generated by minimizing the time until the final sustaining pulse is clamped to the sustaining voltage Vs when the final sustaining pulse rises to the sustaining voltage Vs, and overshooting the sustaining pulse. Generating the auxiliary pulse Pa by the auxiliary pulse generation circuit makes the structure of the plasma display panel complicated, and increases the manufacturing cost, but generating the auxiliary pulse Pa by overshooting can prevent complicating the structure of the plasma display panel and increasing the manufacturing cost.

According to the present embodiment, only one auxiliary pulse Pa is applied to the final sustaining pulse, but the number of auxiliary pulses Pa to be applied is not limited to 1, but 2 or more auxiliary pulses Pa may be applied to the final sustaining pulse.

Fourth Embodiment

Figure 13:
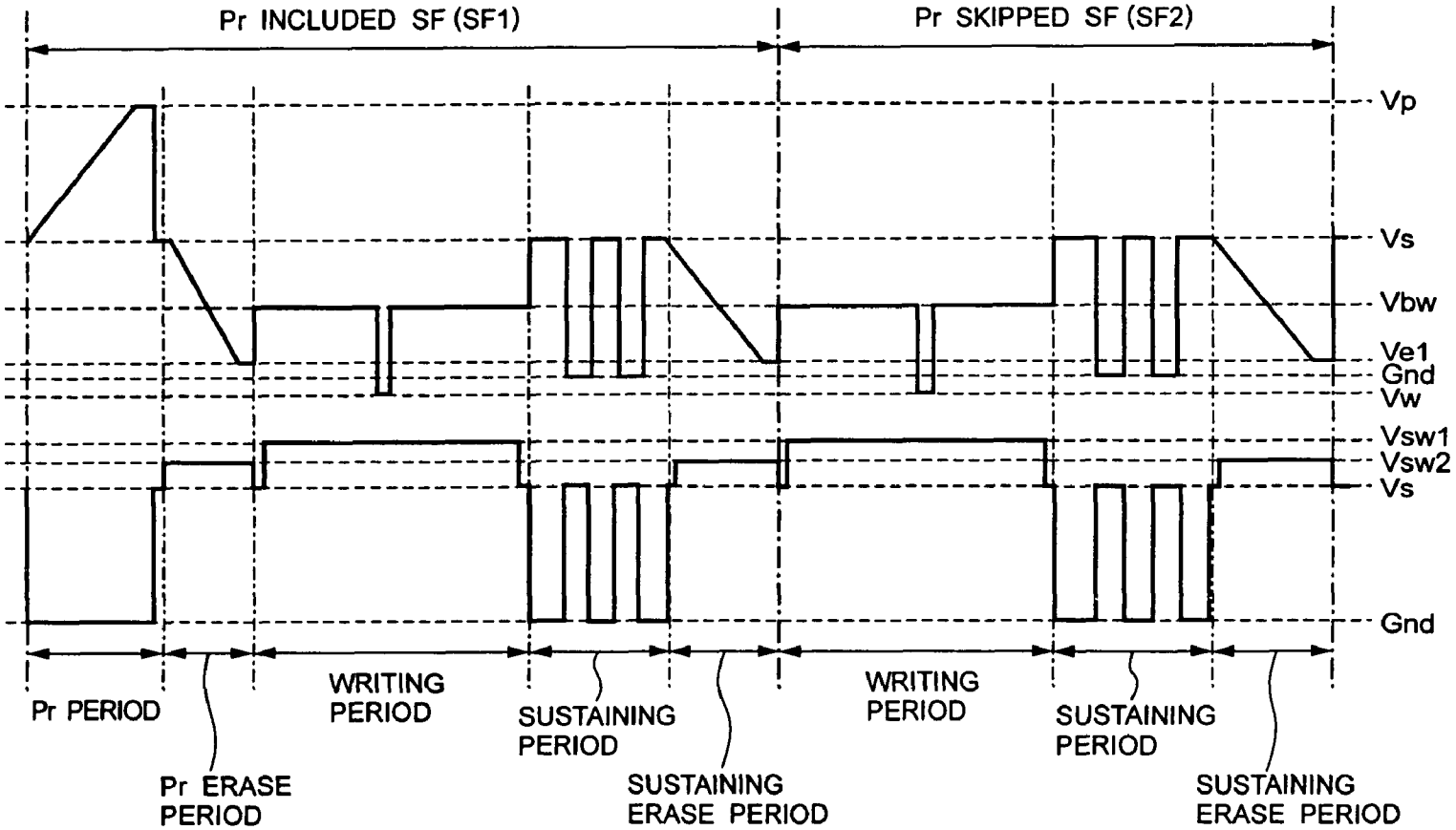
FIG. 13 is a timing chart of the plasma display panel in the plasma display device according to the fourth embodiment of the present invention.

FIG. 13 is a timing chart of the plasma display panel in the plasma display device according to the fourth embodiment.

The plasma display device according to the fourth embodiment has the same structure as the plasma display device according to the first embodiment, but the potentials which are set for the scanning electrode 103 and the common electrode 104 by the central processing unit (CPU) 221 of the controller 22 are different from the potentials of the conventional plasma display panel (see FIG. 38), as described herein below.

According to the present invention, the potential to be applied to the common electrode 104 in the sustaining erase period is set to be equal with the second bias potential Vsw2, just like the first embodiment.

And the potential of the common electrode 104 in the priming erase period is set to the second bias potential Vsw2, which is the same as the potential of the common electrode 104. By this, the surface potential difference between the scanning electrode 103 and the common electrode 104 in the priming erase period is decreased.

The black brightness is generated by emission by the priming discharge and the priming erase discharge. By decreasing the surface potential difference at priming erase, as described in this embodiment, the emission intensity of the priming erase discharge can be decreased, and therefore black brightness can be decreased.

Figure 14:
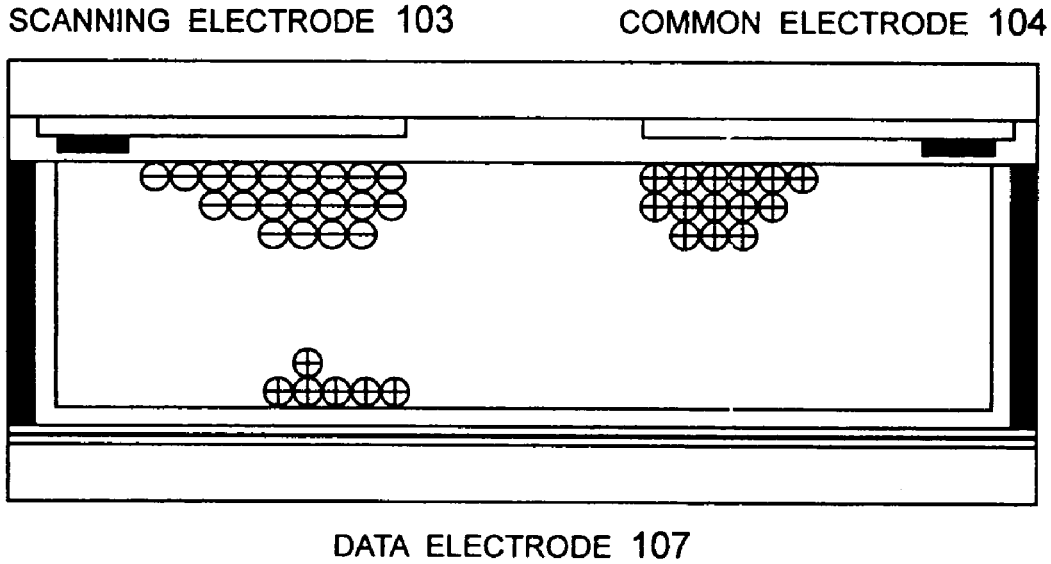
FIG. 14 is a diagram depicting the amount of the wall charges stored near the scanning electrode and the common electrode according to the fourth embodiment of the present invention.

Also wall charges to be erased by the priming erase discharge decrease, so wall charges generated near the scanning electrode 103 and the common electrode 104 increase more than the conventional plasma display panel, as shown in FIG. 14. In other words, wall voltage to be superimposed during writing increases. By this, the minimum value Vd_min of the data voltage Vd and the minimum value Vsw1_min of the first bias potential Vsw1 in the Pr included SF (sub-field SF1) drop. As a result, if the minimum value Vd_min of the data voltage Vd and the minimum value Vsw1_min of the first bias potential Vsw1 in the Pr included SF (sub-field SF1) are higher than those in the Pr skipped SF (sub-field SF2), the drive margin can be increased.

Fifth Embodiment

Figure 15:
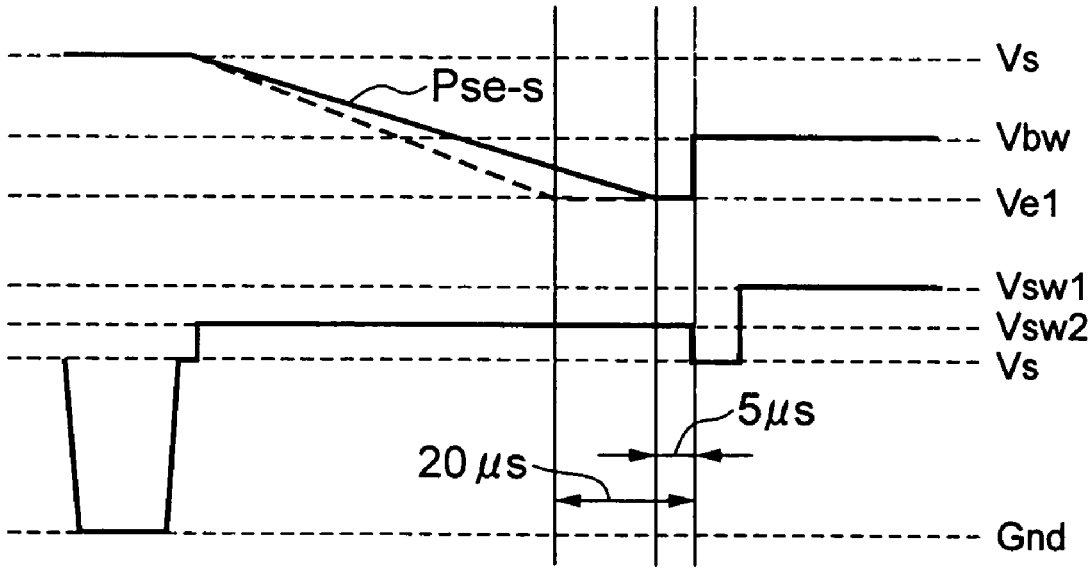
FIG. 15 is a part of the timing chart of the plasma display panel in the plasma display device according to the fifth embodiment of the present invention.

FIG. 15 is a part of the timing chart of the plasma display panel in the plasma display device according to the fifth embodiment.

FIG. 15 is a timing chart of the plasma display panel in the plasma display device according to the first embodiment shown in FIG. 7, wherein the pulses to be applied to the scanning electrode 103 and the common electrode 104 in the Pr included SF (sub-field SF1) in the sustaining erase period are enlarged.

The plasma display device according to the fifth embodiment has the same structure as the plasma display device according to the first embodiment, but the potentials which are set for the scanning electrode 103 and the common electrode 104 by the central processing unit (CPU) 221 of the controller 22 are different from the potentials in the conventional plasma display panel (see FIG. 38), as described herein below.

In the conventional plasma display panel, the time during which the sustaining erase pulse Pse-s (indicated by the dashed line in FIG. 15) is held at the ultimate potential Ve1 in the sustaining erase period is about 20 μs.

Whereas according to the present embodiment, the time during which the sustaining erase pulse Pse-s (indicated by the solid line in FIG. 15) is held at the ultimate potential Ve1 in the sustaining erase period is set to about 5 μs or less.

While the sustaining erase pulse Pse-s is held at the ultimate potential Ve1, the sustaining erase discharge continues, so the wall charges to be erased increase. Therefore as mentioned above, the wall charges which remain after the sustaining erase discharge completes decrease, so the minimum value Vd_min of the data voltage Vd increases.

By decreasing the time during which the sustaining erase pulse Pse-s is being held at the ultimate potential Ve1 as described in this embodiment, the duration of the sustaining erase discharge decreases, so the wall charges to be erased can be decreased, and the abovementioned problems can be suppressed.

The present embodiment may be implemented by combining with the abovementioned first to fourth embodiments.

Sixth Embodiment

Figure 16:
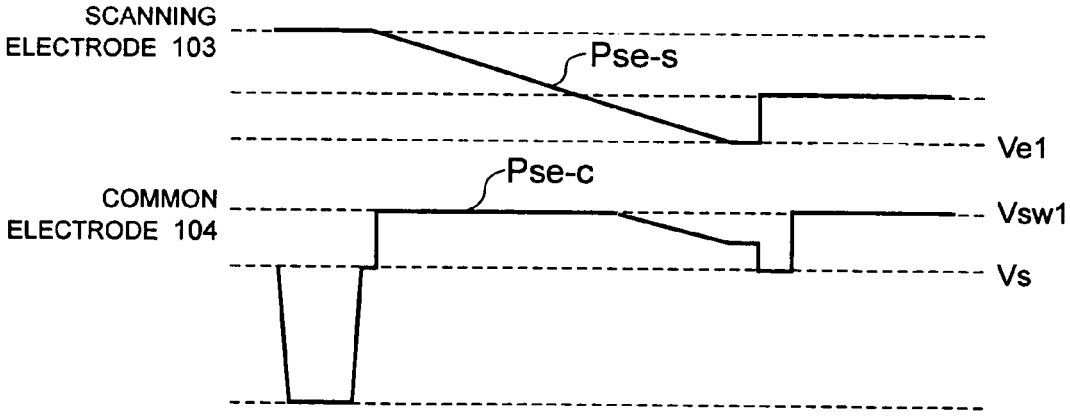
FIG. 16 is a part of the timing chart of the plasma display panel in the plasma display device according to the sixth embodiment of the present invention.

FIG. 16 is a part of the timing chart of the plasma display panel in the plasma device according to the sixth embodiment.

FIG. 16 is a timing chart of the plasma display panel in the plasma display device according to the first embodiment shown in FIG. 7, wherein the pulses to be applied to the scanning electrode 103 and the common electrode 104 in the Pr included SF (sub-field SF1) in the sustaining erase period are enlarged.

Figure 27:
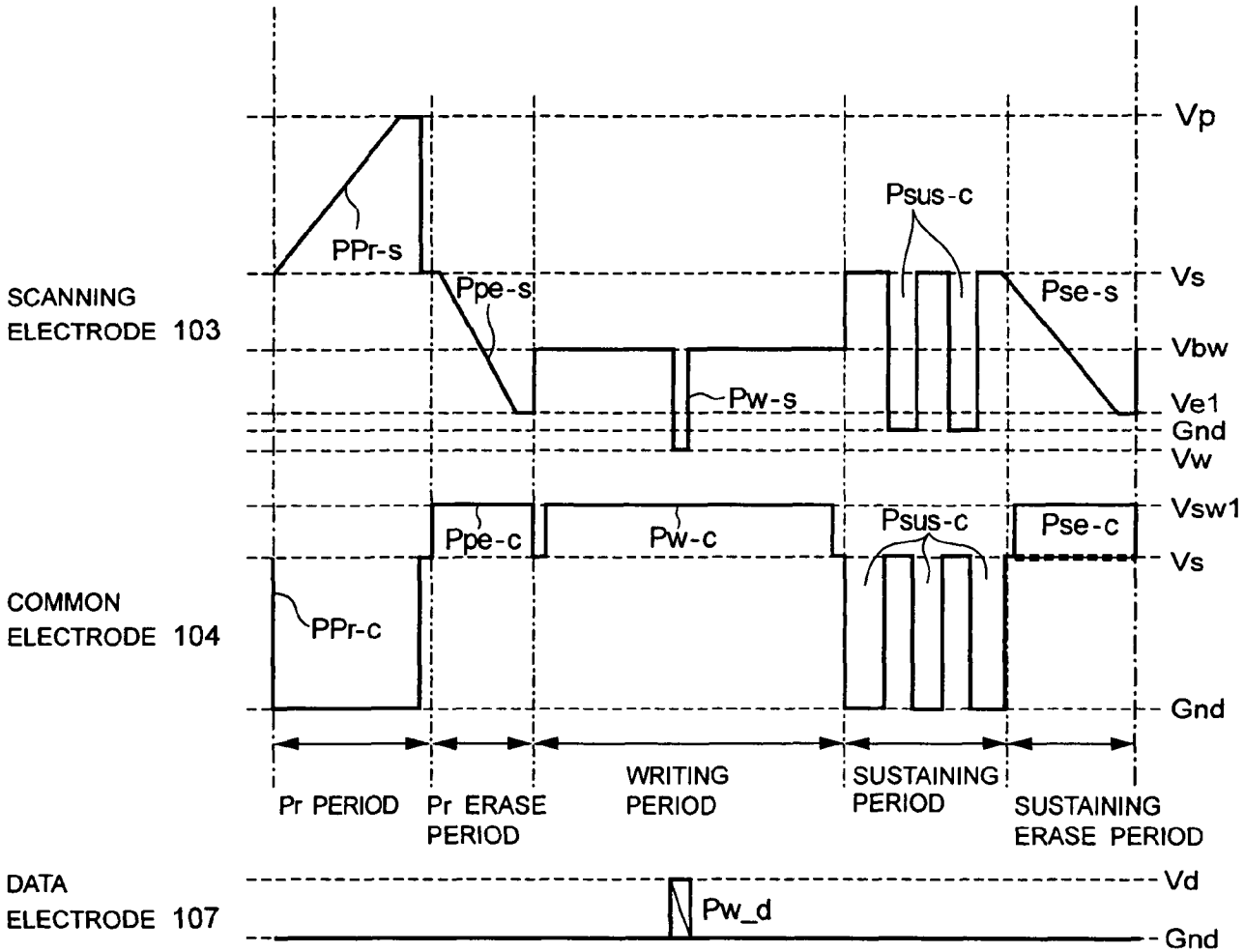
FIG. 27 is a timing chart depicting the writing select type drive operation of the plasma display panel shown in FIG. 25.

Just like the case of the conventional plasma display panel shown in FIG. 27, the common electrode 104 is set to the potential Vsw1 in the sustaining erase period according to the present embodiment, but in the latter half of the sustaining erase period, the potential of the common electrode 104 linear-functionally drops from the potential Vsw1 to a predetermined potential (e.g. potential Vsw2), and rises to the potential Vsw1 again at the end of the sustaining erase period.

Figure 17:
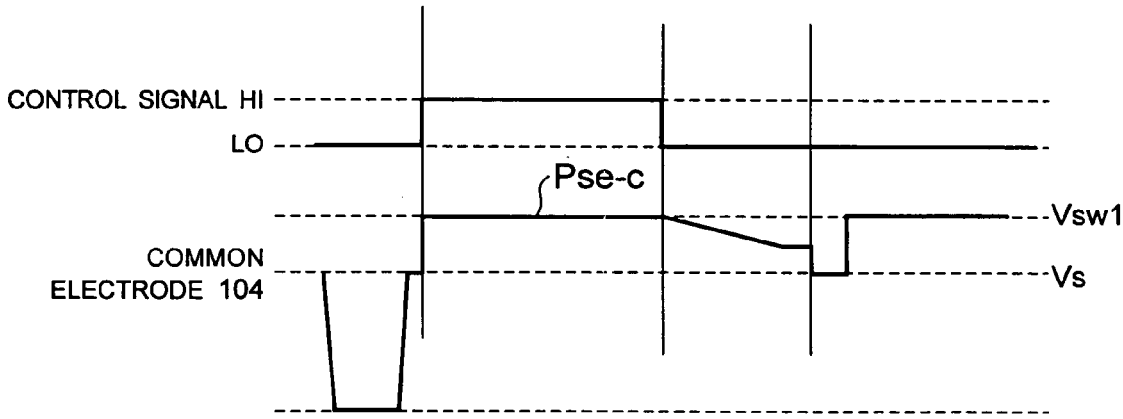
FIG. 17 is a timing chart depicting the relationship between the potential of the common electrode and the control signal of the plasma display panel in the plasma display device according to the sixth embodiment of the present invention.

FIG. 17 is a waveform diagram depicting the relationship of the control signal for controlling the potential of the common electrode 104 and the potential of the common electrode 104.

This control signal is a signal to be supplied to such devices as a field effect transistor (FET) for holding the potential of the common electrode 104 at the potential Vsw1. As FIG. 17 shows, when the control signal is high (HI), the potential of the common electrode 104 is maintained at the potential Vsw1, and when the control signal is low (LO), the potential of the common electrode 104 is not maintained at the potential Vsw1.

In order to drop the potential of the common electrode 104 from the potential Vsw1 to a predetermined potential, the time during which the control signal is not held at high (HI), that is, the time during which the control signal is held at low (LO), is set in the sustaining erase period. While the potential of the common electrode 104 is not maintained at the potential Vsw1, the potential of the common electrode 104 is pulled to the potential of the scanning electrode 103 by the capacity of the plasma display panel. Therefore the potential of the common electrode 104 linear-functionally drops, that is, in the waveform shown in FIG. 18, from the potential Vsw1 to a predetermined potential, then rises again to the potential Vsw1 at the end of the sustaining erase period.

The waveform of the common electrode 104 shown in FIG. 16 can be implemented using a conventional drive circuit, without adding any new circuit or element. Therefore an increase of components of the panel drive circuit and a rise of manufacturing cost can be prevented.

According to the present embodiment, the surface potential difference in the sustaining erase period decreases substantially, so just like the first to fifth embodiments, the wall charges to be erased can be decreased, and the abovementioned problems of the conventional plasma display panel can be suppressed.

The present embodiment may be implemented by combining with the abovementioned first to fifth embodiments.

As described above, according to the plasma display device of the first to sixth embodiments, the drive margin can be increased.

The drive margin can be divided into the Vs margin and the Vd margin, to be described herein below. Each margin will now be described.

First the Vs margin will be described.

When voltages other than the sustaining voltage Vs and the first bias potential Vsw1 are fixed values defined by settings, and the sustaining voltage Vs is increased/decreased while the first bias potential Vsw1 is changed, the minimum voltage of the sustaining voltage Vs with which the entire screen lights with certainty is assumed to be Vs_min, and the voltage with which a lighting error occurs when the sustaining voltage Vs is increased to more than the minimum voltage Vs_min is assumed to be Vs_max.

The differential voltage between this lighting error generation voltage Vs_max and the minimum voltage Vs_min is the Vs margin, and the Vs margin increases as this differential voltage increases.

The sustaining voltage Vs is set to an intermediate voltage between the lighting error generation voltage Vs_max and the minimum voltage Vs_min (Vs_max>Vs>Vs_min).

By setting in this way, stable driving of the plasma display panel at the setup voltage of the sustaining voltage Vs can be implemented even if the characteristic voltage of the plasma display panel changes somewhat.

The value of the sustaining voltage Vs is in proportion to the brightness and the power consumption, so if the sustaining voltage Vs is set to a different value for each characteristic of the plasma display panel, the brightness and the power consumption also change, so the set voltage of the sustaining voltage Vs is fixed to one value.

Figure 18:
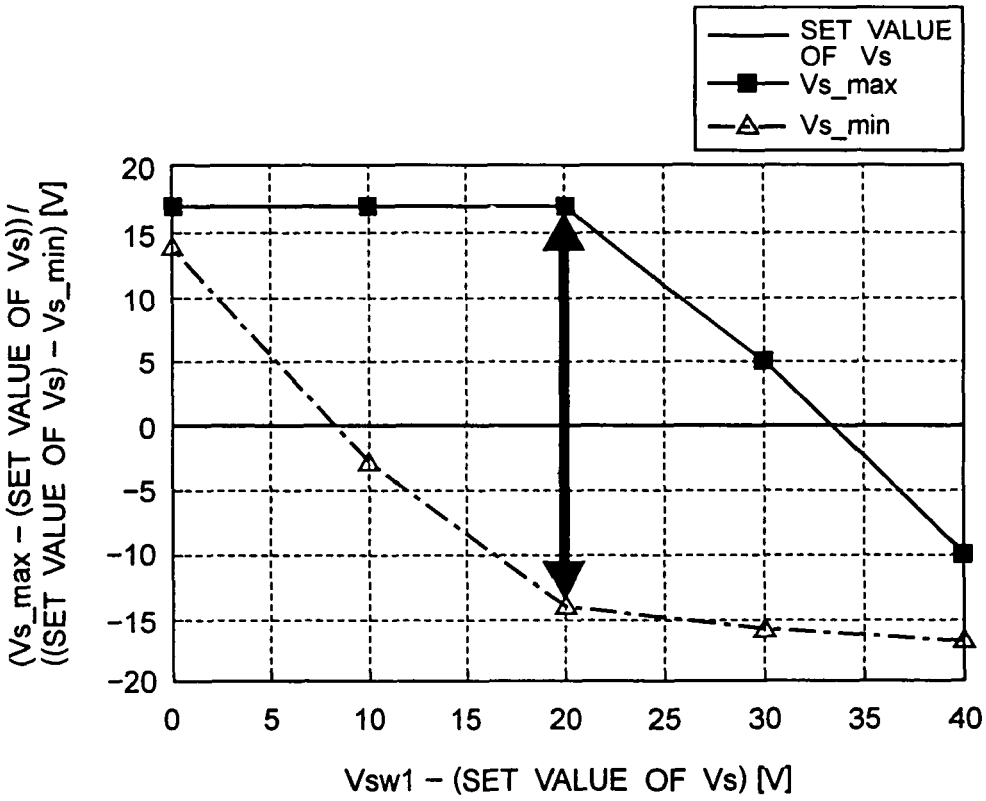
FIG. 18 is a graph depicting the Vs margin in the conventional plasma display panel in which Pr skipped SF is not set.
Figure 19:
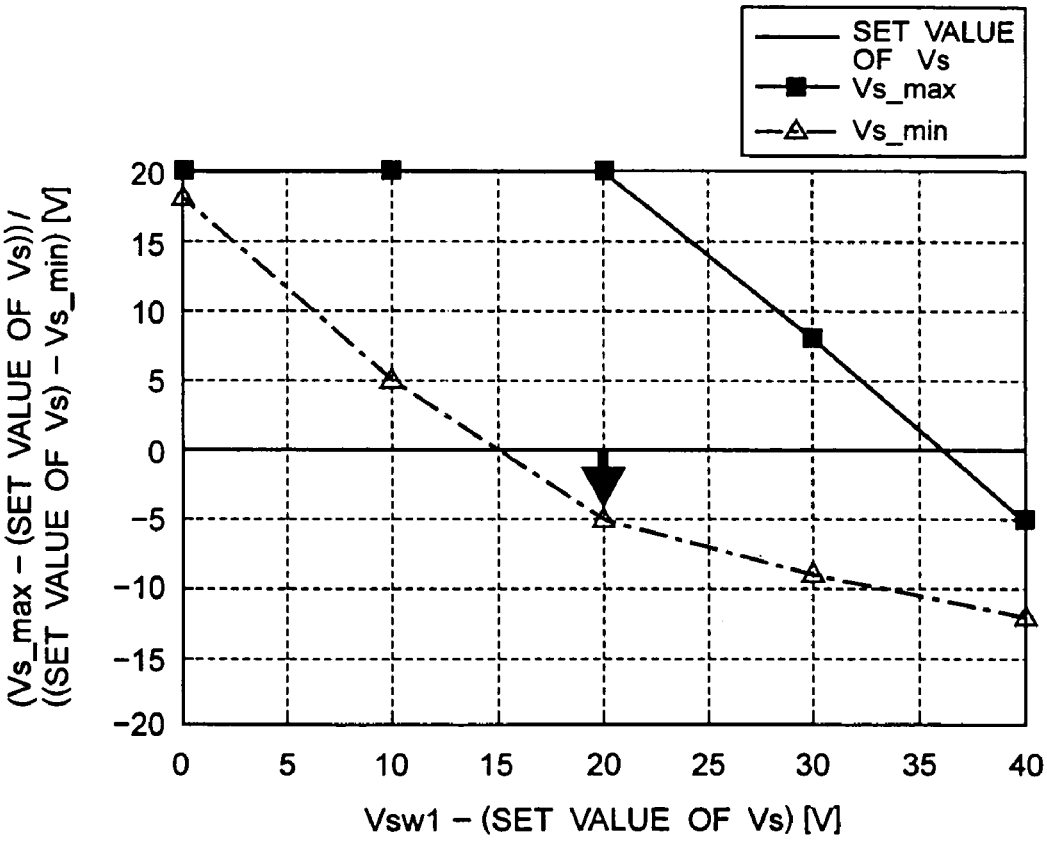
FIG. 19 is a graph depicting the Vs margin in the conventional plasma display panel in which Pr skipped SF is set (the case when the potential of the common electrode in the sustaining erase period is the first bias potential Vsw1)
Figure 20:
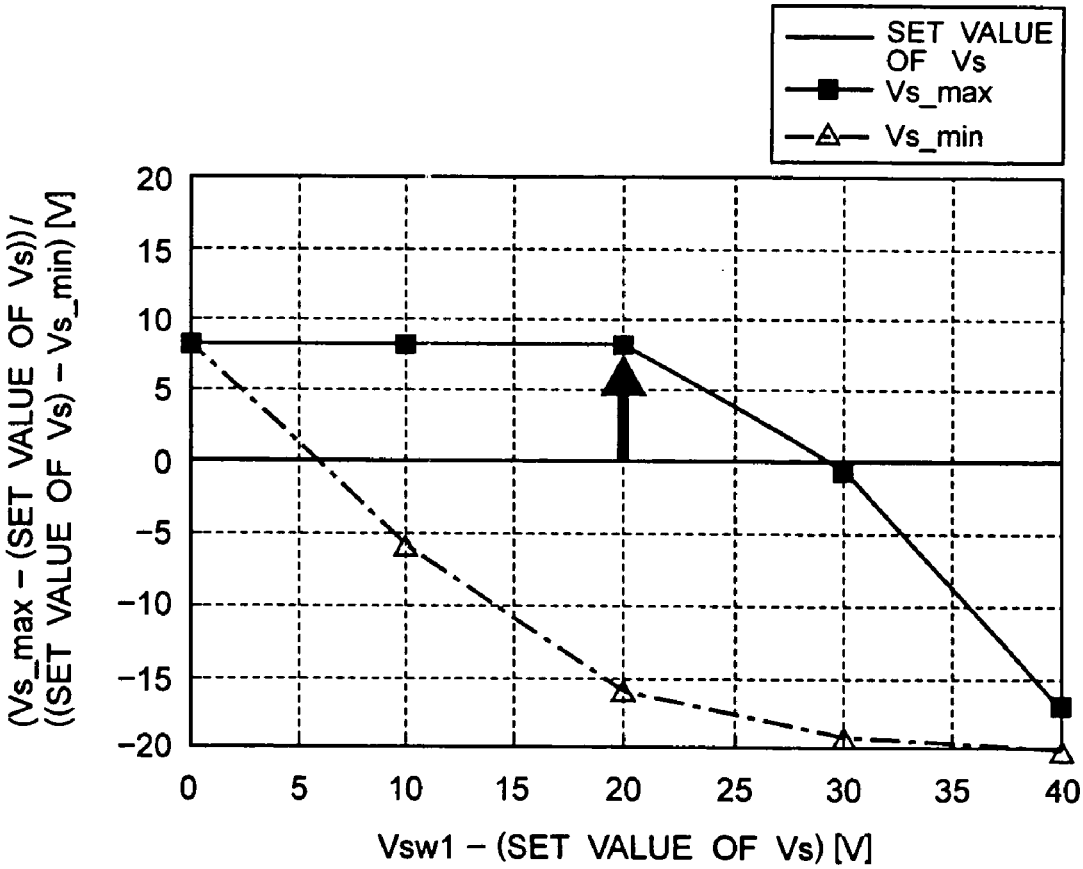
FIG. 20 is a graph depicting the Vs margin in the conventional plasma display panel in which Pr skipped SF is set (the case when the potential of the common electrode in the sustaining erase period is the sustaining potential Vs)
Figure 21:
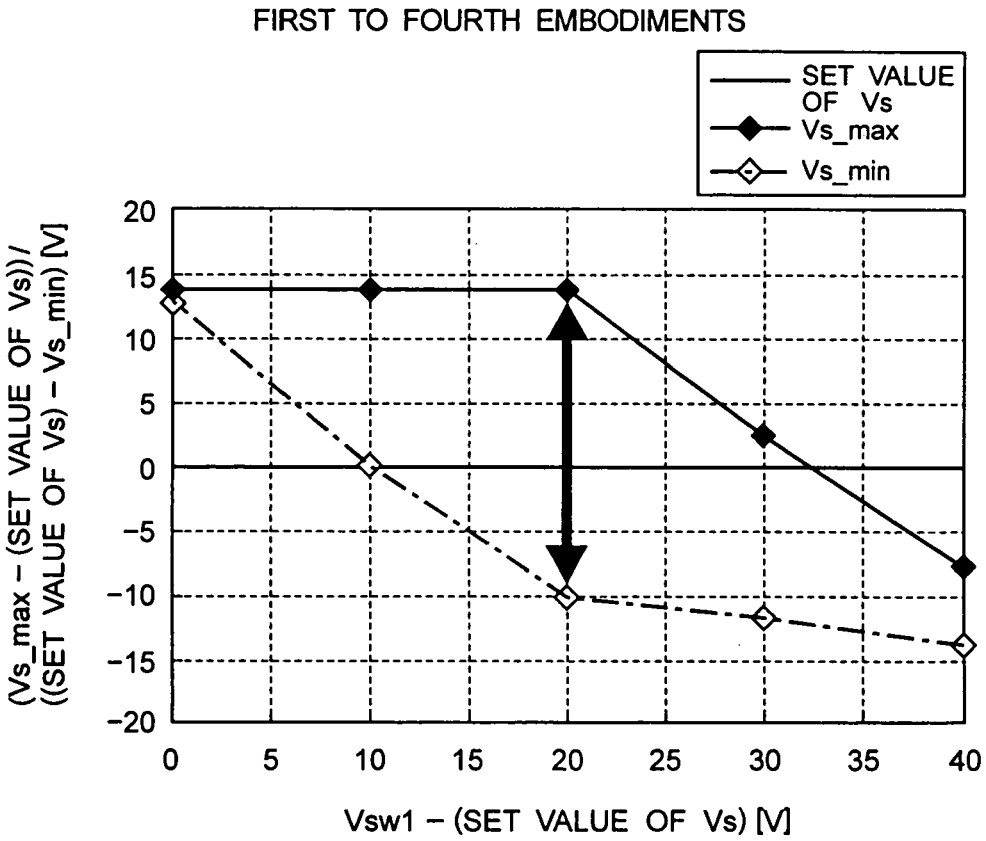
FIG. 21 is a graph depicting the Vs margin in the plasma display panel according to the first to fourth embodiments.

FIG. 18 is a graph depicting the Vs margin in a conventional plasma display panel where the Pr skipped SF is not set, FIG. 19 is a graph depicting the Vs margin in a conventional plasma display panel where the Pr skipped SF is set (in the case when the potential of the common electrode 104 in the sustaining erase period is the first bias potential Vsw1), FIG. 20 is a graph depicting the Vs margin in a conventional plasma display panel where the Pr skipped SF is set (in the case when the potential of the common electrode 104 in the sustaining erase period is the sustaining potential Vs), and FIG. 21 is a graph depicting the Vs margin in the plasma display panel according to the first to fourth embodiments.

In the graphs shown in FIG. 18 to FIG. 21, the ordinate is (Vs_max−(set value of Vs))/((set value of Vs)−Vs_min), and the abscissa is (Vsw1−(set value of Vs)).

As FIG. 18 shows, if the Pr skipped SF is not set, a relatively wide Vs margin can be secured.

Specifically, the Vs margin at the lighting error generation voltage Vs_max side with respect to the set value of Vs is about 17V, and the Vs margin at the minimum voltage Vs_min side with respect to the set value of Vs is about 14V, so a sufficient Vs margin can be secured at both the lighting error generation voltage Vs_max side and the minimum voltage Vs_min side with respect to the set value of Vs.

In the case when the Pr skipped SF is set and the potential of the common electrode 104 in the sustaining erase period is the first bias potential Vsw1, as FIG. 19 shows, the minimum voltage Vs_min becomes relatively high. Because of this, the minimum voltage Vs_min become high with respect to the set value of Vs, so the difference between the set value of Vs and the minimum voltage Vs_min decreases, and as a result the Vs margin at the minimum voltage Vs_min side decreases.

Specifically, the Vs margin at the lighting error generation voltage Vs_max side with respect to the set value of Vs is about 20V, whereas the Vs margin at the minimum voltage Vs_min side with respect to the set value of Vs is only about 5V.

In the case when the Pr skipped SF is set and the potential of the common electrode 104 in the sustaining erase period is the sustaining potential Vs, as shown in FIG. 20, the lighting error generation voltage Vs_max becomes relatively low. Because of this, the lighting error generation voltage Vs_max becomes low with respect to the set value of Vs, so the difference between the set value of Vs and the lighting error generation voltage Vs_max decreases, and as a result the Vs margin at the lighting error generation voltage Vs_max side decreases.

Specifically, the Vs margin at the minimum voltage Vs_min side with respect to the set value of Vs is about 16V, whereas the Vs margin at the lighting error generation voltage Vs_max side with respect to the set value of Vs is only about 8V.

On the other hand, in the Vs margin in the plasma display panel according to the first to fourth embodiment, the Vs margin at the lighting error generation voltage Vs_max side and the Vs margin at the minimum voltage Vs_min side with respect to the set value of Vs can be sufficiently secured even though the Vs margin is narrower than the Vs margin of the conventional plasma display where Pr skipped SF is not set, as shown in FIG. 18.

Specifically, the Vs margin at the minimum voltage Vs_min side with respect to the set value of Vs is about 10V, and the Vs margin at the lighting error generation voltage Vs_max side with respect to the set value of Vs is about 14V, so the Vs margin at the minimum voltage Vs_min side with respect to the set value of Vs is wider than that shown in FIG. 19, and the Vs margin at the lighting error generation voltage Vs_max side with respect to the set value of Vs is wider than that shown in FIG. 20.

Now Vd_min will be described.

When voltages other than the sustaining voltage Vs and the first bias potential Vsw1 are fixed values defined by settings, and the data voltage Vd is increased while the first bias potential Vsw1 is changed, the minimum value of the data voltage Vd, with which the entire screen lights with certainty, is assumed to be the minimum voltage Vd_min.

If the differential voltage between the setting voltage of the data voltage Vd and the minimum voltage Vd_min is defined as the Vd margin, then the characteristic dispersion of the plasma display panel can be covered with more certainty as this differential voltage is large, that is, as the Vd margin is wider. Therefore the wider the Vd margin the better.

Figure 22:
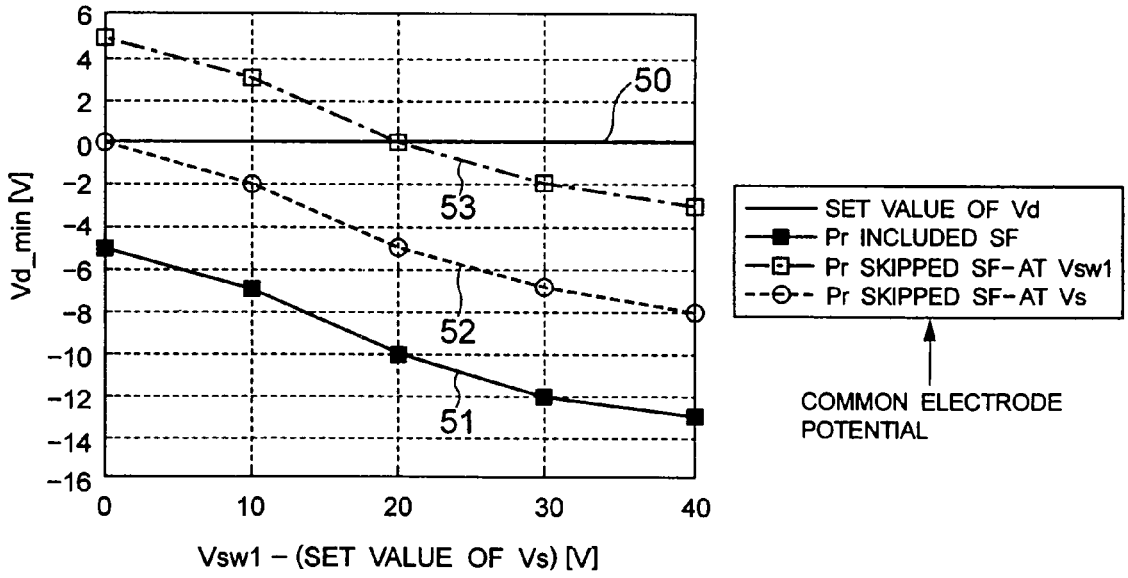
FIG. 22 PRIOR ART
FIG. 22 is a graph depicting the Vd margin in the conventional plasma display panel.
Figure 23:
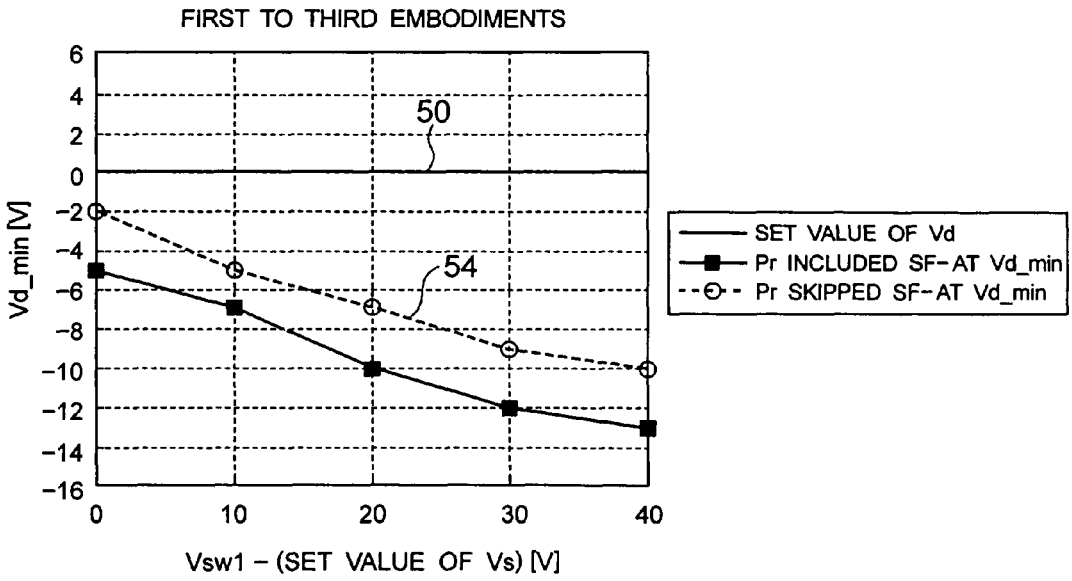
FIG. 23 is a graph depicting the Vd margin in the plasma display panel according to the first to third embodiments.
Figure 24:
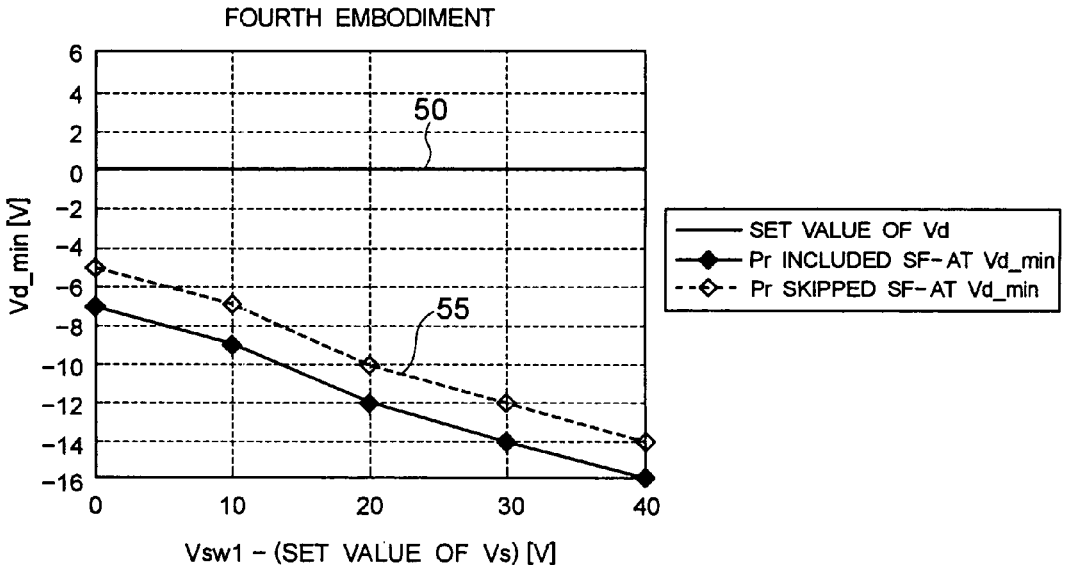
FIG. 24 is a graph depicting the Vd margin in the plasma display panel according to the fourth embodiment.

FIG. 22 is a graph depicting the Vd margin in the conventional plasma display panel, FIG. 23 is a graph depicting the Vd margin in the plasma display panel according to the first to third embodiments, and FIG. 24 is a graph depicting the Vd margin in the plasma display panel according to the fourth embodiment.

In FIG. 22 to FIG. 24, the ordinate indicates the minimum voltage Vd_min, and the abscissa indicates (the first bias potential Vsw1−(set value of Vs)).

In FIG. 22, the broken line 51 of the solid line indicated by black squares is the minimum voltage Vd_min in the Pr included SF, the broken line 52 of the dashed line indicated with circles is the minimum voltage Vd_min in the Pr included SF when the potential of the common electrode 104 is the sustaining voltage Vs, and the broken line 53 of the dash and dotted line indicated by hollow squares is the minimum voltage Vd_min in the Pr included SF when the potential of the common electrode 104 is the first bias potential Vsw1.

As described above, the Vd margin is the differential voltage between the setting voltage 50 of the data voltage Vd and the minimum value Vd_min 51, 52 or 53.

As FIG. 22 shows, the Vd margin (difference between the straight line 50 and the broken line 51) in the Pr included SF is relatively wide, which is in a −5 to −13V range. The minimum value is 5V and the maximum value is 13V.

The Vd margin (difference between the straight line 50 and the broken line 52) is the Pr included SF (when the potential of the common electrode 104 is the sustaining voltage Vs) is relatively small, a 0V to −8V range. The minimum value is 0V, and the maximum value is 8V. The Vd margin (difference between the straight line 50 and the broken line 53) in the Pr included SF (when the potential of the common electrode 104 is the first bias potential Vsw1) is in a 5V to −3V range. The minimum value is 0V and the maximum value is 5V.

On the other hand, as FIG. 23 shows, the Vd margin (difference between the straight line 50 and the broken line 54) according to the first to third embodiments of the present invention is in a −2V to −10V range. The minimum value is 2V and the maximum value is 10V.

Also as FIG. 24 shows, the Vd margin (difference between the straight line 50 and the broken line 55) according to the fourth embodiment of the present invention is in a −5V to −14V range. The minimum value is 5V and the maximum value is 14V.

As the comparison of FIG. 22, FIG. 23 and FIG. 24 clearly shows, the Vd margin according to the first to fourth embodiments of the present invention is wider than the Vd margin according to the conventional plasma display panel.

It is understood that the foregoing description and accompanying drawings set forth the preferred embodiments of the invention at the present time. Various modifications, additions and alternatives will, of course, become apparent to those skilled in the art in the light of the foregoing teachings without departing from the spirit and scope of the disclosed invention. Thus it should be appreciated that the invention is not limited to the disclosed embodiments, but may be practiced within the full scope of the appended Claims.

This application is based on Japanese Patent Application No. 2004-119244, which is hereby incorporated by reference.

What is claimed is:

1. A method of driving a plasma display panel on which images are displayed of a video signal, said plasma display panel comprising a first substrate, a second substrate disposed facing said first substrate, a plurality of scanning electrodes that are disposed on a surface of said first substrate facing said second substrate and extend in a first direction, a plurality of common electrodes that extend parallel with said scanning electrodes on said surface facing said second substrate and are disposed alternately with said scanning electrodes, a plurality of data electrodes that are disposed on a surface of said second substrate facing said first substrate and extend in a second direction crossing said first direction, and display cells disposed at the respective intersections of pairs of said scanning electrode and said common electrode with said data electrodes, said method comprising the steps of:

dividing one field corresponding to one image into a plurality of sub-fields; and arranging at least one second sub-field after a first sub-field of said plurality of sub-fields, wherein in said first sub-field, said method comprising:

a first step of forming wall charges with negative polarity near said scanning electrode and forming wall charges with positive polarity near said common electrode and said data electrode;

a second step of adjusting an amount of the wall charges with negative polarity near said scanning electrode and an amount of the wall charges with positive polarity near said common electrode and said data electrode;

a third step of generating a writing discharge in a selected display cell of said display cells;

a fourth step of generating light emission for display; and a fifth step of erasing a part of the wall charges in the display cell which emits light in said fourth step; and in said second sub-field, said method comprising the same steps as said third, fourth and fifth steps, wherein each of said fifth steps in said first and second sub-fields includes setting a potential difference between said scanning electrode and said common electrode to be smaller than a potential difference between said scanning electrode and said common electrode in each of said third steps in said first and second sub-fields, and said second step in said first sub-field includes setting a potential of said common electrode to be equal to a potential of said common electrode in said fifth step.

2. The method of driving a plasma display panel according to claim 1, wherein the potential of said common electrode in each of said fifth steps in said first and second sub-fields is set to be lower than the potential of said common electrode in each of said third steps in said first and second sub-fields.

3. The method of driving a plasma display panel according to claim 1, wherein let Ve1 denote an ultimate potential of saw tooth pulses to be applied to said scanning electrode in each of said fifth steps in said first and second sub-fields, and a time during which the ultimate potential of said saw tooth pulses is held at said potential Ve1 is 5 μs is or less.

4. The method of driving a plasma display panel according to claim 1, wherein a potential to be applied to said common electrode drops according to a linear function from a first potential to a second potential during a part of a period of said fifth step in said first sub-field.

* * * * *